US005500336A

United States Patent [19]

Asanuma et al.

[11] Patent Number: 5,500,336

[45] **Date of Patent: * Mar. 19, 1996**

[54] SILVER HALIDE PHOTOGRAPHIC MATERIAL

[75] Inventors: Hiroyuki Asanuma; Fumitaka Ueda; Tadaaki Tani, all of Kanagawa, Japan

[73] Assignee: Fuji Photo Film Co., Ltd., Kanagawa, Japan

[ * ] Notice: The portion of the term of this patent subsequent to Sep. 5, 2012, has been disclaimed.

[21] Appl. No.: 187,997

[22] Filed: Jan. 28, 1994

Related U.S. Application Data

[63] Continuation-in-part of Ser. No. 798,197, Nov. 26, 1991, abandoned.

[30] Foreign Application Priority Data

| | | | |
|---|---|---|---|
| Nov. 27, 1990 | [JP] | Japan | 2-323550 |
| Nov. 29, 1990 | [JP] | Japan | 2-332803 |
| May 17, 1991 | [JP] | Japan | 3-140712 |

[51] Int. Cl.[6] ..... G03C 1/04

[52] U.S. Cl. ..... 430/570; 430/569; 430/599; 430/627

[58] Field of Search ..... 430/569, 570, 430/599, 627, 559, 560

[56] References Cited

U.S. PATENT DOCUMENTS

| | | | |
|---|---|---|---|
| 4,163,023 | 7/1979 | Endo et al. | 430/399 |
| 4,442,201 | 4/1984 | Takada et al. | 430/570 |
| 4,713,321 | 12/1987 | Mifune et al. | 430/569 |
| 4,728,603 | 3/1988 | Yagi et al. | 430/569 |
| 4,783,396 | 11/1988 | Nakamura et al. | 430/606 |
| 4,845,023 | 7/1989 | Mifune | 430/569 |
| 4,863,845 | 9/1989 | Murai et al. | 430/569 |
| 4,914,010 | 4/1990 | Momoki | 430/399 |
| 5,141,846 | 8/1992 | Fickie et al. | 430/569 |

FOREIGN PATENT DOCUMENTS

| | | | |
|---|---|---|---|
| 63-040139 | 2/1988 | Japan | 430/569 |
| 63-040137 | 2/1988 | Japan | 430/569 |
| 4199044 | 7/1992 | Japan . | |
| 545760 | 2/1993 | Japan . | |

OTHER PUBLICATIONS

English language abstract of JP 4–199044, "Halogenated Silves Photosensitive Material", Ueda et al., Jul. 1992.

*Primary Examiner*—Charles L. Bowers, Jr.
*Assistant Examiner*—John A. McPherson
*Attorney, Agent, or Firm*—Sughrue, Mion, Zinn, Macpeak & Seas

[57] ABSTRACT

A silver halide photographic material comprising a support having thereon at least one silver halide emulsion layer, where at least one silver halide emulsion layer contains a silver halide emulsion obtained by treating a silver halide emulsion containing a dye previously added thereto with a solid adsorbent which is a porous organic synthetic resin without any ion exchange group to thereby desorb the dye adsorbed.

23 Claims, No Drawings

SILVER HALIDE PHOTOGRAPHIC MATERIAL

CROSS-REFERENCE TO RELATED APPLICATION

This is a continuation-in-part of application Ser. No. 07/798,197 filed on Nov. 6, 1991, now abandoned.

FIELD OF THE INVENTION

The present invention relates to a silver halide photographic material, and more particularly to a silver halide photographic material which has improved performance with regard to chemical sensitization, dye absorption and spectral sensitization by desorbing a part or all of an unwanted material formed after carrying out the formation of grains in the presence of a dye or chemical sensitization during preparation of a silver halide emulsion.

BACKGROUND OF THE INVENTION

Generally, silver halide emulsions are prepared through a sequence of steps where a soluble silver salt and a soluble halide are mixed in an aqueous solution of gelatin to form silver halide grains and physical ripening, desalting and chemical sensitization are then carried out.

Methods are known where adsorptive compounds such as dyes as crystalline phase-controlling agents are added during the course of grain formation to obtain a desired crystalline phase or to introduce defects intentionally into the crystalline phase during grain formation. These method are described in U.S. Pat. Nos. 2,735,766, 3,628,960, 4,183,756 and 4,225,666 and JP-A-61-205929 (the terms "JP-A" as used herein means an "unexamined published Japanese patent application").

Dyes as chemical sensitizing aids are often added during chemical sensitization to control chemical sensitization nuclei, thus improving the high-intensity reciprocity failure and controlling intrinsic desensitization. These methods are described in, for example, JP-A-58-113926, JP-A-58-113927, JP-A-58-113928, U.S. Pat. Nos. 4,439,520 and 4,435,501, *Research Disclosure*, Item 17643, Section III, JP-A-62-6251, JP-A-58-126525, JP-A-62-56948, JP-A-62-43644, JP-A-58-113928, JP-A-1-40938, JP-A-1-62631, JP-A-1-62632, JP-A-1-74540 and Japanese Patent Application Nos. 62-203635, 62-219982, and 62-251377.

Examples of the dyes which can be added in the above methods as chemical sensitizing aids include cyanine dyes, merocyanine dyes, complex cyanine dyes, holopolar cyanine dyes, hemicyanine dyes, styryl dyes and hemioxonol dyes. These dyes are described, in, for example, JP-A-61-160739.

However, when dyes are used as the crystalline phase controlling agents, photographic performance is greatly deteriorated due to development restraint, residual color and intrinsic desensitization by adsorbed dyes. Further, when spectral sensitization is carried out by adsorbing sensitizing dyes in a subsequent stage, the crystalline phase controlling agents seriously interface with the adsorption of the dyes and there is difficulty in dye adsorption. When dyes are used as the chemical sensitization aids, the photographic performance is greatly deteriorated due to development restraint, residual color, and intrinsic desensitization by the adsorbed dyes as in the above case. In addition, when spectral sensitization is carried out by sensitizing dye adsorption in a subsequent step, the chemical sensitization aids seriously interfere with dye adsorption. Accordingly, development of a method wherein a part or all of the dyes added as crystalline phase controlling agents or chemical sensitization aids can be removed from the silver halide emulsions after completion of the formation of the grains or chemical sensitization is required.

Nitrogen-containing heterocyclic compounds having no spectrally sensitizing capability are adsorptive compounds which can be added during the course of grain formation as crystalline phase-controlling agents to obtain a desired crystalline phase or to introduce defects intentionally into the crystalline phase during grain formation, or can be added during chemical sensitization as chemical sensitization aids to control chemical sensitization nuclei. These nitrogen containing heterocyclic compounds having no spectrally sensitizing capability, when used to control the crystalline phase, exhibit the same adverse influences as the dyes which are added to control the crystalline phase of the grains, and when used as chemical-sensitization aids exhibit the same adverse influences as the dyes which are added as chemical-sensitization acids.

Silver halide solvents are adsorptive compounds which can be added during the course of grain formation as crystalline phase-controlling agents to obtain a desired crystalline phase or to introduce defects intentionally into the crystalline phase during grain formation, or can be added during chemical sensitization as chemical sensitization aids to control chemical sensitization nuclei. These silver halide solvents, when used to control the crystalline phase, exhibit the same adverse influences as the dyes which are added to control the crystalline phase of the grains, and when used as chemical-sensitization aids exhibit the same adverse influences as the dyes which are added as chemical-sensitization acids.

SUMMARY OF THE INVENTION

An object of the present invention is to provide a silver halide photographic material which has improved performance:

1. as to chemical sensitization such as an increase in sensitivity and a reduction in fogging, and
2. as to dye adsorption by desorbing the dyes used as crystalline phase controlling agents or chemical sensitization aids.

Another object of the present invention is also to provide a silver halide photographic material which has the same improved performance as above by desorbing the dyes used as those other than crystalline phase controlling agents or chemical sensitization aids (for example, sensitizing dyes, desensitizing dyes or dyestuffs).

A further object of the present invention is to provide a silver halide photographic material in which a nitrogen-containing heterocyclic compound having no spectrally-sensitizing capability or a silver halide solvent has also been adsorbed into the silver halide emulsion and then desorbed.

The above-described and other objects of the present invention have been achieved by:

(1) a silver halide photographic material comprising a support having thereon at least one silver halide emulsion layer, wherein at least one silver halide emulsion layer contains a silver halide emulsion obtained by treating a silver halide emulsion containing a dye previously added thereto with a solid adsorbent which is a porous organic synthetic resin without an ion-exchange group to thereby desorb the dye adsorbed, and (2) a silver halide photographic material as described in (1) above wherein the silver halide emulsion is one obtained by treating a silver halide emulsion with a solid adsorbent in the presence of a desorption accelerator for silver halide grains.

In a preferred embodiment of the invention, a silver halide photographic material as in (1) or (2) above is provided in which a nitrogen-containing heterocyclic compound having no spectrally sensitizing capability or a silver halide solvent has also been adsorbed onto the silver halide emulsion and then desorbed by a porous organic synthetic resin without an ion-exchange group.

DETAILED DESCRIPTION OF THE INVENTION

The present invention is illustrated below in greater detail.

In the present invention, a part or all of the dye is removed from a silver halide emulsion containing the dye previously added thereto during the preparation of the silver halide emulsion until the silver halide emulsion is coated on a support.

Methods for removing chemical sensitizing agents or chemical sensitization aids, which are useless after chemical sensitization, by using adsorption carriers such as ion exchange resins and inorganic ion exchangers are disclosed in JP-A-61-219948, JP-A-61-219949, JP-A-62-23035 and JP-A-62-240951. However, removal of dyes used as chemical sensitizing dyes or crystalline phase controlling agents are not disclosed in these documents.

The removal of the dyes and chemical sensitizing agents (other than dyes) or chemical sensitization aids, which are useless, are disclosed in JP-A-1-201651. The removal method described therein is a combination of pH or pAg control with a washing stage, but desorption is insufficiently achieved. A removal method using a solid adsorbent for dyes as in the present invention is not disclosed therein at all.

The desorption ratio of the dye is preferably not lower than 50%, more preferably 80 to 100% in the present invention.

Dyes used as crystalline phase controlling agents or chemical sensitization aids subsequently removed in the present invention include cyanine dyes, merocyanine dyes, complex cyanine dyes, holopolar cyanine dyes, hemicyanine dyes, styryl dyes and hemioxonol dyes. Particularly useful dyes are cyanine dyes, merocyanine dyes and complex merocyanine dyes.

Any nuclei conventionally utilized as basic heterocyclic nuclei for cyanine dyes can be present in these dyes. Examples of such nuclei include a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus and a pyridine nucleus; nuclei formed by fusing alicyclic hydrocarbon rings to these nuclei; and nuclei formed by fusing aromatic hydrocarbon rings to these nuclei such as an indolenine nucleus, a benzindolenine nucleus, an indole nucleus, a benzoxazole nucleus, a naphthoxazole nucleus, a benzthiazole nucleus, a naphthothiazole nucleus, a benzoselenazole nucleus, a benzimidazole nucleus and a quinoline nucleus. These nuclei may optionally have substituent groups on their carbon atoms.

Five-membered to six-membered heterocyclic nuclei such as a pyrazoline-5-one nucleus, a thiohydantoin nucleus, a 2-thiooxazolidine-2,4-dione nucleus, a thiazolidine-2,4-dione nucleus, a rhodanine nucleus and a thiobarbituric acid nucleus as nuclei with a keto-methylene structure can be present in merocyanine dyes or complex merocyanine dyes.

For example, the compounds described in *Research Disclosure*, No. 17643, page 23, item IV (December, 1978) and compounds described in the literature cited therein can be used.

More specifically, the following compounds can be used.

5,5'-Dichloro-3,3'-diethylthiacyanine bromide.

Na salt of 5,5'-dichloro-3,3'-di(4-sulfobutyl)thiacyanine

Na salt of 5-methoxy-4,5-benzo-3,3'-di(3-sulfopropyl)thiacyanine 5,5'-Dichloro-3,3'-diethylselenacyanine iodide 5,5'-Dichloro-9-ethyl-3,3'-di(3-sulfopropyl)thiacarbocyanine pyridinium Anhydro-5,5'-dichloro-9-ethyl-3-(4-sulfobutyl)-3'-ethylcyanine hydroxide 1,1'-Diethyl-2,2'-cyanine bromide 1,1'-Dipentyl-2,2'-cyanine perchlorate 9-Methyl-3,3'-di(4-sulfobutyl)thiacarbocyanine pyridinium Na salt of 5,5'-diphenyl-9-ethyl-3,3'-di(2-sulfoethyl)oxacarbocyanine Na salt of 5-chloro-5'phenyl-9-ethyl-3-(3-sulfopropyl)-3'-(2-sulfoethyl)oxacarbocyanine Na salt of 5,5'-dichloro-9-ethyl-3,3'-di(3-sulfopropyl)oxacarbocyanine Na salt of 5,5"-dichloro-6,6'-dichloro-1,1'-diethyl-3,3'-di(3-sulfopropyl)imidacarbocyanine Na salt of 5,5'-diphenyl-9-ethyl-3,3'-di(3-sulfopropyl)thiacarbocyanine These dyes used as crystalline phase controlling agents or chemical sensitization aids can be used in an amount of $4\times10^{-6}$ to $8\times10^{-3}$ mol per mol of silver halide. More preferably, the dyes are used in an amount of about $5\times10^{-5}$ to $2\times10^{-3}$ mol when the silver halide grains have a grain size of 0.2 to 1.2 μm.

Nitrogen-containing heterocyclic compounds having no spectrally sensitizing capability or silver halide solvents may be used in combination with the dyes, whereby a silver halide emulsion having even higher sensitivity can be obtained with prevention or fog. The nitrogen-containing heterocyclic compounds having no spectrally sensitizing capability are organic compounds having a nitrogen-containing heterocyclic ring, having no spectrally sensitizing capability and being capable of adsorbing on the surface of silver halide grains. Examples of the nitrogen-containing heterocyclic ring include a pyrazole ring, a pyrimidine ring, a 1,2,4-triazole ring, a 1,2,3-triazole ring, a 1,3,4-thiadiazole ring, a 1,2,3-thiadiazole ring, a 1,2,4-thiadiazole ring, a 1,2,5-thiadiazole ring, a 1,2,3,4-tetrazole ring, a pyridazine ring, a 1,2,3-triazine ring, a 1,2,4-triazine ring, a 1,3,5-triazine ring, a benzotriazole ring, a benzimidazole ring, a benzothiazole ring, a quinoline ring, a benzoxazole ring, a benzoselenazole ring, a naphthothiazole ring, a naphthoimidazole ring, a rhodanine ring, a thiohydantoin ring, an oxazole ring, a thiazole ring, an oxadiazole ring, a selenadiazole ring, a naphthoxazole ring, an oxazolidinedione ring, a triazolotriazole ring, an azaindene ring (e.g., a diazaindene ring, a triazaindene ring, a tetrazaindene ring, a pentazaindene ring), a phthalazine ring and an indazole ring.

Of these nitrogen-containing heterocyclic compounds, the compounds having an azaindene ring are preferably used in the present invention. Specifically, the azaindene compounds having a hydroxyl group as a substituent, and more specifically hydroxy-tetrazaindene compounds are preferably used.

The nitrogen-containing heterocyclic compounds may have a substituent other than a hydroxyl group, such as an alkyl group, an alkylthio group, an amino group, a hydroxyamino group, an alkylamino group, a dialkylamino group, an arylamino group, a carboxyl group, an alkoxycarbonyl group, a halogen atom, an acylamino group, a cyano group or a mercapto group.

Examples of the nitrogen-containing heterocyclic compounds are shown below, which, however, are not to be construed as limiting the invention in any way.

4-Hydroxy-6-methyl-1,3-3a,7-tetrazaindene
4-Hydroxy-6-t-butyl-1,3,3a,7-tetrazaindene
4-Hydroxy-6-phenyl-1,3-3a,7-tetrazaindene
4-Hydroxy-1,3,3a,7-tetrazaindene
4-Methyl-6-hydroxy-1,3,3a,7-tetrazaindene
2-Methylthio-4-hydroxy-6-methyl-1,3,3a,7-tetrazaindene
4-hydroxy-5-bromo-6-methyl-1,3,3a,7-tetrazaindene
4-Hydroxy-6-methyl-1,2-3a,7-tetrazaindene
4-Hydroxy-6-ethyl-1,2,3a-7-tetrazaindene
2,4-Dihydroxy-6-phenyl-1,3a,7-tetrazaindene
4-Hydroxy-6-phenyl-1,2,3,3a,7-tetrazaindene
Adenine
Guanine
Benzotriazole
5-Methylbenzotriazole
5-Nitro-benzimidazole
5-(m-cyanophenyl)tetrazole
1-Phenyl-5-mercaptotetrazole
1-(m-Sulfophenyl)-5-mercaptotetrazole
1-(3,5-Dicarboxyphenyl)-5-mercaptotetrazole
1-Ethyl-5-mercaptotetrazole
1-Methyl-2-mercapto-1,3,5-triazole
1-Phenyl-2-mercaptoimidazole
2-Mercapto-5-sulfobenzothiazole
2-Mercapto-5-methylbenzimidazole
1-Mercapto-3-methylthiothiadiazole
2-Ethyl-3-methyl-β-naphthothiazolium-p-toluenesulfonate These compounds can be used in an amount of $10^{-5}$ to $10^{-1}$ mol, preferably $10^{-4}$ to $3\times10^{-2}$ mol, more preferably $2\times10^{-4}$ to $10^{-2}$ mol per mol of silver halide. The heterocyclic compounds may be added to the silver halide emulsion in any time of before chemical ripening and during the chemical ripening, and preferably before chemical ripening.

The chemical sensitization-aiding function of the nitrogen-containing heterocyclic compound having no spectrally sensitizing capability is considered to be comparable to that of spectrally sensitizing dye. Both the compounds prevent fog and increase sensitivity. The use manner thereof is also the same. Namely, the sensitizing dye is added in the system during formation of grains so as to control crystal habit of the grains, and the nitrogen-containing heterocyclic compound is also added during formation of grains when it is used for the same purpose (control of crystal habit). They also exhibit the same adverse influence when the treatment with a porous organic synthetic resin having no ion-exchange groups is omitted. Namely, the previously added sensitizing dye or nitrogen-containing heterocyclic compound prevent absorption of spectrally sensitizing dye as subsequently added. Thus, the addition time (period) of the nitrogen-containing heterocyclic compound having no spectrally sensitizing capability may be the same as that of the dye which is used as a chemical sensitizing aid.

The desorption ratio of the nitrogen-containing heterocyclic compound without ion exchange groups is preferably not less than 70% of the amount added and more preferably is 70% to 100%.

Examples of silver halide solvents which can be used in the present invention include thiocyanate (e.g., potassium thiocyanate, ammonium thiocyanate, etc.), thioether compounds (a) (e.g., the compounds disclosed in U.S. Pat. Nos. 3,021,215, and 4,276,374), and thione compounds (b) (e.g., the compounds disclosed in JP-B-59-11892, JP-B-60-11341, and U.S. Pat. No. 4,221,863). Examples of the compounds (a) and (b) above are shown below.

$$HO-(CH_2)_2S(CH_2)_2S(CH_2)_2OH \quad (a)$$

$$HO-\underset{\underset{OH}{|}}{CH_2CH}CH_2S(CH_2)_2S\underset{\underset{OH}{|}}{CH_2CH}CH_2OH$$

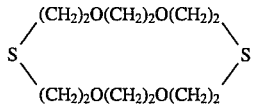

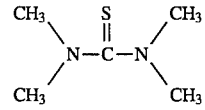

(b)

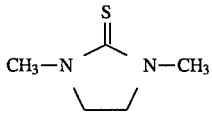

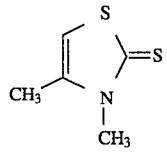

The amounts of the silver halide solvents can be chosen appropriately. For example, when thiocyanates are used, the amount is in the range of from $1\times10^{-5}$ to $3\times10^{-1}$ mol, preferably $1\times10^{-4}$ to $1\times10^{-1}$ mol, more preferably $5\times10^{-4}$ to $1\times10^{-1}$ mol per mol of silver halide. The silver halide solvents are preferably added to the silver halide emulsion before chemical ripening.

The silver halide solvent has the same function as the dye which is added as a chemical sensitizing aid and prevents fog and increases sensitivity. Thus, the addition time is the same as that of the dye. The adverse influence of the silver halide solvent without the porous organic synthetic resin treatment is the prevention of absorption of spectrally sensitizing dye and deterioration of storability.

The desorption ratio of the silver halide solvent is preferably not less than 50% of the amount added and more preferably is 50% to 100%.

The solid adsorbent of the present invention is an organic solid which is insoluble in water. Specifically, the solid adsorbent is a porous organic synthetic resin without an ion exchange group.

Typical porous resins which can be used in the present invention are synthetic organic resins with macropores having an average pore size of 500 nm or less.

Appropriate porous organic synthetic resins without an ion exchange group which can be used in the present invention are organic synthetic resins (1) with macropores having an average pore size of 500 nm or less and (2) without any functional group which itself is dissociated into positive and negative ions, such as a quaternary amine group, a carboxyl group or a sulfo group. Specifically, examples of the suitable resins include styrene-divinylbenzene copolymers, chloromethyl-styrene-divinylbenzene copolymers, methoxymethylol-divinylbenzene copolymers, ethylene-divinylbenzene copolymers, methyl methacrylate-divinylbenzene copolymers and methyl methacrylate-divinylbenzene copolymers.

In particular, these resins have the following structures.

1.

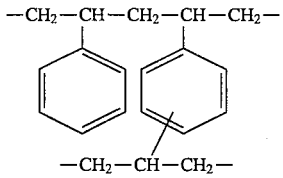

2.

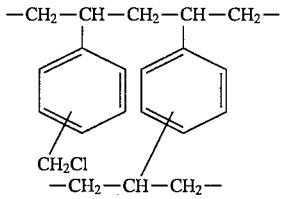

3.

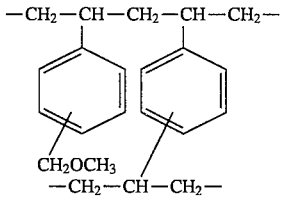

4.

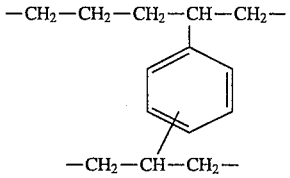

5.

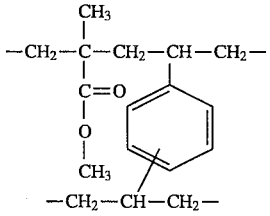

6.

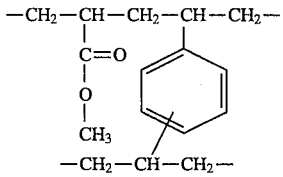

Conventional methods of the synthesis of porous resins include a linear polymer addition method and a precipitant addition method described in Josei Hojo, *Chelate Resin Ion Exchange Resin*, chapter 2 (p. 127-) published by K ōdansha (1976). Basically, the resins may be synthesized by any method. Some of the above-described porous resins are commercially available and can be readily obtained. Specific examples of commercially available porous resins without ion exchange groups are shown in the tables below.

Products of Mitsubishi Kasei Corporation

| Name | Resin Matrix | Specific Surface Area ($m^2$)/g-HP) | Pore Volume (ml/g-HP) | Max. Frequency Radius (Å) |
|---|---|---|---|---|

-continued

Products of Mitsubishi Kasei Corporation

| | | | | |
|---|---|---|---|---|
| HP10 | Styrene based | 500 | 0.9 | 100–700 |
| 20 | Styrene based | 720 | 1.1 | 100–1300 |
| 30 | Styrene based | 570 | 1.0 | 100–900 |
| 40 | Styrene based | 700 | 0.7 | 100–600 |
| 50 | Styrene based | 600 | 0.9 | 900 |

| Name | Particle Size (μm) | Specific Surface Area ($m^2$/g) | Pore Volume (ml/g) |
|---|---|---|---|
| MCI GEL CHP20P | 37–75 | 500–700 | >1 |
| " | 75–150 | 500–700 | >1 |
| " | 150–300 | 500–700 | >1 |

| Name | Resin Matrix | Specific Surface Area ($m^2$)/g-HP) | Pore Volume (ml/g-HP) | Average Pore Size (Å) |
|---|---|---|---|---|
| XAD 1 | Styrene based | 100 | — | 205 |
| 2 | Styrene based | 300 | 0.6 | 90 |
| 4 | Styrene based | 784 | 1.1 | 50 |
| 7 | Styrene based | 450 | 0.8 | 90 |
| 8 | Styrene based | 140 | 0.5 | 235 |
| 9 | Sulfoxide based | 69 | — | 366 |
| 11 | Amide based | 69 | — | 352 |
| 12 | N-O-polar group | 22 | — | 1300 |

The above-described solid adsorbents are available in various forms, but particle form, powder form and film form are preferred.

It is preferred that the size of the solid adsorbent is 2 times or more larger than that of silver halide grain present in the silver halide emulsion. More preferably, the size of the solid adsorbent is from 10 to 100 times larger than that of the silver halide grain. This is because the solid adsorbent is often left behind in the silver halide emulsion after the silver halide emulsion is treated with the solid adsorbent of the present invention. There are adsorbents which do not have an adverse effect, though they remain in the emulsion. However, it is preferred that the solid adsorbent is removed from the emulsion, for example, by filtration.

The description "desorption of the dye with the solid adsorbent of the present invention from the silver halide emulsion" as used herein refers to a stage wherein the solid adsorbent is added batchwise to the silver halide emulsion, the mixture is stirred and mixed and the solid adsorbent is then removed; or a stage wherein an adsorption bed or an adsorption tube is continuously packed with the solid adsorbent and the silver halide emulsion is passed therethrough. The present invention can be applied to any stage.

The amount of the solid adsorbent to be used can be appropriately chosen depending on performance (e.g., overall adsorption capability, pore volume) and form (e.g., particle size, effective surface area) of the adsorbents and the types of materials (e.g., the types of chemical sensitization aids and dyes) present in the silver halide emulsions to be treated. For example, when the adsorbent is added batchwise, the amount of the adsorbent used is in the range of 0.1 to 1000 g, preferably 1 to 800 g, more preferably 40 to 400 g per kg of the silver halide emulsion. With continuous addition, the amount of the adsorbent is the same range as used in batchwise addition when it is considered that the amount of the solid adsorbent is based on the total amount of the silver halide emulsion passed therethrough.

The treating temperature may be in the range of from a temperature (about 30° C.) at which the silver halide emulsion is liquefied, to a temperature which the solid adsorbent can withstand. The treating time is at least one minute with batchwise addition as well as continuous addition.

The treating time with the solid adsorbent in the present invention can be appropriate chosen depending on the silver halide emulsions to be treated. When dyes are used as crystalline phase controlling agents, it is preferred that the treatment be carried out after completion of the formation of the grains. When dyes are used as chemical sensitization aids, it is preferred that the treatment is carried out after completion of chemical sensitization, but just before coating, and it is most preferred that the treatment is carried out immediately after completion of chemical sensitization. When dyes used as crystalline phase controlling agents are the same as those used as chemical sensitization aids, it is preferred that the treatment is carried out after completion of chemical sensitization. When the dyes used as crystalline phase controlling agents are different from the dyes used as chemical sensitization aids, it is desirable that the treatment with the solid adsorbent is carried out once after completion of the formation of the grains to remove the dye as the crystalline phase controlling agent, the dye as the chemical sensitization aid is added before commencement of chemical sensitization, and the treatment with the adsorbent is again carried out after completion of chemical sensitization, but just before coating.

The nitrogen-containing heterocyclic compounds having no spectrally sensitizing capability or the silver halide solvents may be added simultaneously or separately with addition of the dyes. The addition time of these compounds may vary depending on the intended roles of the compounds. For instance, the nitrogen-containing heterocyclic compounds and the silver halide solvents may be added during formation of grains for the purpose of control of crystal habit. When used as chemical sensitizing aids, on the other hand, they may be added after the grain formation and before completion of chemical sensitization.

In the case that the sensitizing dye and the heterocyclic compound or silver halide solvent are added for different roles, for example, the dye is added as a chemical sensitizing aid and the heterocyclic compound or silver halide solvent is added for control of crystal habit, the latter is preferably added during the grain formation and the dye is preferably added after the grain formation and before completion of the chemical sensitization. If the presence of the heterocyclic compound or silver halide solvent is not favorable in the chemical sensitization, the dye is preferably added after the formed grains are treated with a porous organic synthetic resin having no ion-exchange group. After addition of the dye and completion of the chemical sensitization, the same resin treatment is conducted to desorb the dye. On the other hand, if the heterocyclic compound or silver halide solvent has no adverse influence such as prevention of chemical sensitization, the grains formed after addition of the heterocyclic compound or silver halide solvent need not be subjected to the resin treatment before addition of the dye and it suffices to conduct the resin treatment all at once after addition of the dye and completion of the chemical sensitization.

The amount of the dye, when used in combination with the nitrogen-containing heterocyclic compound or silver halide solvent, may be the same as or different from the amount of the dye as used alone. However, the total amount of the dye, the nitrogen-containing heterocyclic compound and the silver halide solvent is preferably $1\times10^{-5}$ to $1\times10^{-2}$ mol per mol of silver halide, and particularly preferably $5\times10^{-5}$ to $8\times10^{-5}$ mol per mol of silver halide having a preferred grain size of 0.2 to 1.2 μm. The ratio of the dye to the nitrogen-containing heterocyclic compound or silver halide solvent is not particularly limited.

When dyes are added for spectral sensitization, the treatment with the solid adsorbent must be completed before commencement of the addition of the spectral sensitizing dyes.

Examples of dyes as spectral sensitizing agents after the desorption of the above dyes, nitrogen containing heterocyclic compounds and silver halide solvents include cyanine dyes, merocyanine dyes, complex cyanine dyes, holopolar cyanine dyes, hemicyanine dyes, styryl dyes and hemioxonol dyes. Particularly useful dyes are cyanine dyes, merocyanine dyes and complex merocyanine dyes. Any nuclei conventionally used as basic heterocyclic nuclei for cyanine dyes can be employed in these dyes. Examples of such nuclei include a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus and a pyridine nucleus; and nuclei formed by fusing aromatic hydrocarbon rings to these nuclei such as an indolenine nucleus, a benzindolenine nucleus, an indole nucleus, a benzoxazole nucleus, a naphthoxazole nucleus, a benzthiazole nucleus, a naphthothiazole nucleus, a benzoselenazole nucleus, a benzimidazole nucleus and a quinoline nucleus. These nuclei may optionally have substituent groups on their carbon atoms.

Five-membered to six-membered heterocyclic nuclei such as a pyrazoline-5-one nucleus, a thiohydantoin nucleus, a 2-thio-oxazolidine-2,4-dione nucleus, a thiazolidine-2,4-dione nucleus, a rhodanine nucleus and a thiobarbituric acid nucleus as nuclei with a keto-methylene structure can be present in merocyanine dyes or complex merocyanine dyes.

For example, the compounds described in *Research Disclosure*, No. 17643, page 23, item IV (December 1978) and compounds described in the literature cited therein can be used.

These dyes as spectral sensitizing agents can be used in an amount of $4\times10^{-6}$ to $8\times10^{-3}$ mol per mol of silver halide. More preferably, these dyes are used in an amount of about $5\times10^{-5}$ to $2\times10^{-3}$ mol when the silver halide grains have a grain size of 0.2 to 1.2 μm.

The term "desorption accelerator" as used herein refers to a compound which shifts the equilibrium of the adsorptive material between the surface of silver halide grain and dispersion medium to the dispersion medium side, that is, a compound which shifts the equilibrium to the dispersion side to a degree such that the concentration of the sensitizing dye, sodium salt of 5,5'-dichloro-3,3'-di(n-sulfopropyl)-9-ethylthiacarbocyanine (hereinafter referred to as Dye A) on the dispersion medium side becomes at least twice the initial concentration when Dye A in an amount of 0.4 g/mol of Ag is added to a silver bromide octahedral emulsion (grain size: 1 μm), the mixture is stirred at 60° C. for 60 minutes, 1 g of the compound is added to 40 g of the resulting emulsion and the mixture is stirred at 40° C. for 60 minutes.

Examples of suitable desorption accelerator compounds include alcohols, phenols, naphthols, ketones, carboxylic acids and derivatives thereof, cyclic ethers, esters and dipolar non-proton solvents. More preferred examples of these compounds include methanol, ethanol, propanol, phenol, compounds represented by the following general formula

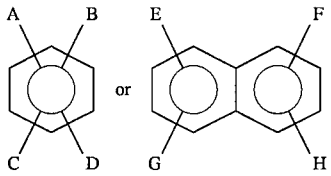

(wherein A to H each represent a member selected from the group consisting of a hydrogen atom, a hydroxy group, an alkoxy group, a sulfone group, a carboxyl group and an amino group), acetone, acetic acid, ethyl acetate, tetrahydrofuran, dimethylformamide, dimethyl sulfoxide and pyridine.

Of these compounds, phenol, 1-naphthol, 2-naphthol, 1-2-dihydroxynaphthalene, 1,3-dihydroxynaphthalene, 1,4-dihydroxynaphthaline, 1,5-dihydroxynaphthalene, 1,6-dihydroxynaphthaline, 2,3-dihydroxynaphthalene, 2,6-dihydroxynaphthalene and 2,7-dihydroxy-naphthalene are particularly preferred.

The desorption accelerator may be added at any stage before the treatment with the solid adsorbent is completed. However, it is preferred that the description accelerator is added just before or immediately after the treatment with the solid adsorbent.

The desorption accelerator may be used in such an amount that the desorption of the adsorptive compound is accelerated. The amount of the desorption accelerator is preferably 0.1 to 1000 times, more preferably 1 to 200 times, particularly preferably 1 to 50 times, that of the adsorptive compound.

Dyes can be removed much more completely from the silver halide emulsions by using the desorption accelerators in the present invention.

Preferred embodiments of the present invention area as follows:

(1) A silver halide photographic material containing at least one silver halide emulsion which is treated with a solid adsorbent after chemical sensitization in the presence of a dye.

(2) A silver halide photographic material containing at least one silver halide emulsion which is treated with a solid adsorbent after completion of the formation of the grains or chemical sensitization wherein a dye is added during the course of the formation of the grains.

(3) The silver halide emulsion as described in (1) and (2) above, wherein the emulsion is treated with a solid adsorbent in the presence of an absorption accelerator for silver halide grains.

(4) The silver halide emulsion after the treatment of the present invention as describe in (1) and (2) above, wherein the emulsion is subsequently spectral-sensitized with a methine dye.

(5) The silver halide emulsion as described in (1) above, wherein the emulsion is chemically sensitized in the presence of a dye, preferably a cyanine dye, a mecrocyanine dye, a complex cyanine dye, a holopolar cyanine dye, a hemicyanine dye, a styryl dye or a hemioxonol dye, more preferably a cyanine dye.

(6) The silver halide emulsion as described in (2) above, wherein the emulsion is chemically sensitized or the grains are formed in the presence of a dye, preferably a cyanine dye, a merocyanine dye, a complex cyanine dye, a holopolar cyanine dye, a hemicyanine dye, a styryl dye or a hemioxonol dye, more preferably a cyanine dye.

(7) The silver halide emulsion as described in (1) or (2) above, wherein the emulsion is one in which a nitrogen-containing heterocyclic compound having no spectrally sensitizing capability has also been adsorbed onto the silver halide emulsion and then desorbed by a porous organic synthetic resin without an ion exchange group.

(8) The silver halide emulsion as described in (1) or (2) above, wherein the emulsion is one in which a silver halide solvent has also been adsorbed onto the silver halide emulsion and then desorbed by a porous organic synthetic resin without an ion exchange group.

Any of silver bromide, silver iodobromide, silver chlorobromide, silver iodide and silver chloride can be used as the silver halide in the photographic emulsions of the present invention.

The grain size distribution may be narrow or wide.

The silver halide grains in the photographic emulsions may have a regular crystal form such as a cubic, octahedral, tetradecahedral or rhombic dodecahedral form, an irregular crystal form such as a spherical or plate form, a crystal form having a face of a high order [(hKI) face] or a composite form of those crystal forms. Grains having a face of a high order are described in *Journal of Imaging Science*, Vol. 30, pp. 247–254 (1986).

Silver halide grains may be composed of a structure such that the interior of the grain and the surface layer thereof are different phases, or the grains may be composed of a uniform phase. Double to multiple structural grains wherein the interior of the grain and the surface layer thereof have a different iodide composition (particularly, with the iodine content of the interior being higher) are preferred. Grains having a transition line are also preferred.

A crystal formed by growing a silver halide crystal on an oxide crystal such as PbO, a silver halide crystal formed by epitaxial growth (e.g., a crystal formed by growing epitaxially silver chloride, silver iodobromide or silver iodide on silver bromide) and a crystal formed by orientated overgrowth of a regular hexahedral silver chloride on hexagonal silver iodide may be used.

The grain size distribution of the silver halide grains in the photographic emulsions can vary and may be a monodisperse system. The term "monodisperse system" as used herein refers to a dispersion wherein grains having a grain size of within ±60%, preferably ±40%, of the number-average grain size account for 95% of the entire grains. The term "number-average grain size as used herein refers to the number-average diameter of the diameters of circles, each circle having an area equal to the projected area of a grain.

The silver halide grains used in the present invention are grains of silver bromide, silver chloride, silver iodide, silver chlorobromide, silver chloroiodide, silver iodobromide and silver chloroiodobromide. Other silver salts such as silver rhodanide, silver sulfide, silver selenide, silver carbonate, silver phosphate and silver salts of organic acids may be used as separate grains or may be incorporated partly in the silver halide grains. Silver halide grains having a high silver chloride content are preferred when development and desilverization (bleaching, fixing and bleaching-fixing) stages are to be conducted rapidly. When development is to be appropriately restrained, grains containing silver iodide are preferred. The preferred content of silver iodide varies depending on the photographic materials to be used. For example, the amount of silver iodide is in the range of preferably 0.1 to 15 mol % for X-ray photographic materials, and in the range of preferably 0.1 to 5 mol % for graphic arts and micro photographic materials. With photographic materials for photography such as typical color negative films, a silver halide containing preferably 1 to 30 mol %, more preferably 5 to 20 mol %, particularly preferably 8 to 15 mol %, of silver iodide is used. It is preferred from the standpoint of relaxing lattice strain for silver chloride to be incorporated in silver iodobromide grains.

It is preferred for the grains in the silver halide emulsions of the present invention to have a distribution or specific structures with regard to halogen composition. Typical examples of such grains include core/shell type grains or double structure type grains wherein the interior of grain and the surface layer thereof have a different halogen composition from each other as disclosed in JP-B-43-13162 (the term "JP-B as used herein means an "examined Japanese patent publication"), JP-A-61-215540, JP-A-60-222845, JP-A-60-143331 and JP-A-61-75337. In addition to the simple double structure grain, triple structure or multiple structure type grains and grains having a structure such that a thin layer of silver halide is deposited on the surface of a core/shell double structure type grain can be formed.

Not only the above surrounding structure, but also grains having a joined structure to produce a structure in the interior of the grain can be formed. Examples of grains having a joined structure include grains formed by joining a crystal on the edges, corners or planes of a host crystal, the crystal to be joined having a different composition from that of the host crystal, as described in JP-A-59-133540, JP-A-58-108526, European Patent 199,2909A2, JP-B-58-24772 and JP-A-59-16254. The joined crystal can be formed, irrespective of whether the host crystal is uniform with regard to the halogen composition or has a core/shell type structure.

When the grains have a joined structure, silver halides can be appropriately combined together. Further, a silver salt compound without rock salt structure, such as silver rhodanide or silver carbonate can be combined with the silver halide to form a joined structure. Furthermore, a non-silver salt compound such as lead oxide can be combined to form a joined structure.

With silver chlorobromide grains having these structures,, it is desirable for the silver iodide content of the core to be higher than that of the shell. In same cases, however, it is preferred for the silver iodide content of the core to be lower than that of the shell. Similarly, with grains having joined structures, the silver iodide content of the host crystal may be relatively higher or lower than that of the joined crystal. The boundary portion between layers having these structures may be clear or not clear. A boundary where the halogen composition is continuously changed is also preferred.

When silver halide grains are composed of a mixed crystal of two or more silver halides or have a certain structure, it is important that the halogen composition distribution between the grains is controlled. A method for measuring the halogen composition distribution between the grains is described in JP-A-60-254032. A desirable characteristic is for the halogen distribution between grains is uniform. Particularly, emulsions with a high uniformity such that the coefficient of variation is 20% or less, are preferred. In another embodiment, emulsions with a correlation between grain size and halogen composition are preferred. For example, emulsions with a correlation such that a larger-size grain has a higher iodide content, while a smaller-size grain has a lower iodide content are suitable. Reversed correlation and the correlation of other halogen composition can be chosen depending on the purpose. For this purpose, it is preferred to mix two or more emulsions with different compositions.

It is important for the halogen composition in the vicinity of the surface of the grain to be controlled. When the silver iodide content or the silver chloride content in the vicinity of the surface of the grain is increased, the absorptivity of the dye and development rate are changed. Accordingly, the content of silver iodide or silver chloride is chosen depending on the purpose. When the halogen composition in the vicinity of the surface of the grain is to be changed, grains with a structure such that all of the grain is surrounded or grains with a structure such that silver iodide or silver chloride is deposited only on a part of the grain, can be chosen. For example, the halogen composition only on one face of tetradecahedral grain having the (100) face and the (111) face is changed, or the halogen composition of one of the principal surface and the side surface of the tabular grain is changed.

The silver halide grains of the present invention may be regular crystals with no twin plane or crystals described in *Foundation of Photographic Industry, Silver Salt Photograph*, page 163, edited by Photography Society of Japan (Corona Sha) such as a singlet twin having one twin plane, parallel multiplet twin having at least two parallel planes and non-parallel multiplet twin with at least two non-parallel twin planes. These crystals can be used depending on the purpose. Mixtures of grains with different shapes are described in U.S. Pat. No. 4,865,964. If desired, this method can be used. When the grains have a regular crystal form, cubic grains composed of a (100) face, octahedral grains composed of a (lllj) face and dodecahedral grains composed of a (110) face described in JP-B-55-42737 and JP-A-60-222842 can be used. Further, grains with (hll) faces as typified by a (211) face, grains with (hhl) faces as typified by a (331) face, grains with (hkO) faces as typified a (210) face and grains with (hkl) faces as typified by a (321) face as described in *Journal of Imaging Science*, Vol. 30, page 247 (1986) can be used depending on the purpose, though they must be prepared with care. Grains with two or more crystal faces such as tetradecahedral grains wherein the (100) face and the (111) face coexist on one grain; grains wherein the (100) face and the (110) face coexist; and grains wherein the (111) face and the (110) face coexist; can also be used depending on the purpose.

A value obtained by dividing a diameter of a circle having an area equal to the projected area of one grain by the thickness of the grain is called the aspect ratio. The shape of a tabular grain is defined by the aspect ratio. Tabular grains with an aspect ratio of 1 or more can be used in the present invention. Tabular grains can be prepared according to the methods described in Cleve, *Photography Theory and Practice*, page 131 (1930); Gutoff, *Photographic Science and Engineering*, vol. 14, pp. 248–257 (1970); U.S. Pat. Nos. 4,434,226, 4,414,310, 4,433,048 and 4,439,520 and U.K. Patent 2,112,157. When tabular grains are used, there are advantages in that the covering power is increased and dye sensitizing efficiency can be increased when sensitizing dyes are used. The details thereof are described in U.S. Pat. No. 4,434,226. It is preferred that tabular grains with an aspect ratio of preferably 1 or more, but less than 100, more preferably 2 or more, but less than 20, particularly preferably 3 or more, but less than 10 account for at least 80% of the entire projected area of the grains. The shapes of the tabular grains are a triangular shape, a hexagonal shape or a circular shape. A regular hexagonal shape wherein the lengths of six sides are almost equal as described in U.S. Pat. No. 4,797,354 is a preferred shape.

The grain size of the tabular grain is often represented in terms of a diameter of a circle having an area equal to the projected area of the grain. Grains having a mean grain size of 0.6 μm or less as described in U.S. Pat. No. 4,748,106 are preferred from the standpoint of providing an image of high quality. Emulsions having a narrow grain size distribution as described in U.S. Pat. No. 4,775,617 are preferred. With regard to the thickness of the tabular grains, a thickness of 0.5 μm or less, preferably 0.3 μm or less is preferred from the standpoint of increasing sharpness. Further, emulsions comprising grains having a uniform thickness such that the coefficient of variation in the thicknesses of the grains is 30% or less are preferred. Furthermore, grains with a specific thickness and a specific distance between twin planes as described in JP-A-63-163451 are also preferred.

With tabular grains, transition lines can be observed through a transmission type electron microscope. It is preferred for the grains to have no transition line, but grains having several transition lines or grains having many transition lines are chosen depending on the purpose. Further, grains having transition lines linearly introduced in a specific direction in the crystalline orientation of the grain, and grains having curved transition lines can be selected. The transition lines may be introduced into all of the grain or a specific part of the grain, for example, the fringe part of the grain. It is preferred that the introduction of the transition lines is applied to not only tabular grains, but also regular crystalline grains and indefinite shape grains such as typically potato-form grains. In these cases, it is preferred to introduce transition lines in specific parts such as the apex or ridge of the grain.

The silver halide emulsions which are used in the present invention may be subjected to a treatment for rounding the grains as described in European Patents 96,727B1 and 64,412B1 or a treatment for modifying the surfaces of the grains as described in West German Patent 2,306,447C2 and JP-A-60-221320.

Generally, the grains have a structure such that the surface thereof is flat. If desired, the surface may be intentionally made uneven. For example, an uneven surface may be formed by a method for making a part of the crystal uneven, for example, making a hole in the apex or the center of the plane as described in JP-A-58-106532 and JP-A-60-221320. An example of grains with an uneven surface include ruffle grains as described in U.S. Pat. No. 4,643,966.

The grain size of the emulsion used in the present invention can be evaluated by the diameter of a sphere equal to the volume of the grain calculated from the thickness of the grain and the diameter of a circle having an area equal to the projected area of the grain through an electron microscope or by the diameter of a sphere equal to the volume of the grain using a coulter counter method. Grains can be chosen from grains ranging from ultrafine particles having a grain size of 0.05 μm or less in terms of the diameter of a sphere to coarse large-size grains with a grain size of larger than 10 μm. Grains having a grain size of 1 μm or more, but 3 μm or less are preferred photosensitive silver halide grains.

A polydisperse emulsion with a wide grain size distribution or a monodisperse emulsion with a narrow grain size distribution can be used as the emulsion of the present invention. The coefficient of variation in terms of the diameters of circles with areas equal to the projected areas of the grains or in terms of the diameters of spheres with volumes equal to the grains, is often used as a criterion of grain size distribution. When monodisperse emulsions are used, emulsions having a coefficient of variation of 25% or less, preferably 20% or less, more preferably 15% or less are preferred.

A monodisperse emulsion is sometimes defined by a grain size distribution such that grains with a grain size within the mean grain size ±30% account for at least 80% (in terms of the number of grains or the weight of grains) of all of the grains. In forming emulsion layers with substantially the same color sensitivity, two or more monodisperse silver halide emulsions may be present in the same layer or may be multi-layer-coated as separate layers to obtain the gradation required for photographic materials. Further, two or more polydisperse silver halide emulsions or a combination of a monodisperse emulsion and a polydisperse emulsion may be mixed or multi-layer-coated.

The photographic emulsions which are used in the present invention can be prepared by the methods described in P. Glafkides, *Chimie et Physique Photographique*, Paul Montel (1967), G. F. Duffin, *Photographic Emulsion Chemistry* (Focal Press, 1966) and V. L. Zelikman et al., *Making and Coating Photographic Emulsion*, Focal Press (1964). Specifically, any of the acid process, the neutral process and the ammonia process can be used. A soluble silver salt and a soluble halide can be reacted using the single jet process, the double jet process or a combination thereof. A reverse mixing method wherein grains are formed in the presence of an excess of silver ion can be used. Further, a controlled double jet process wherein the pAg in the liquid phase, in which silver halide is formed, is kept constant can be used. According to this process, a silver halide emulsion wherein the grains have a regular crystal form and the grain size thereof is nearly uniform can be used.

Often methods are preferred wherein silver halide grains, which are previously precipitated and formed, are added to a reaction vessel for the preparation of the emulsion as described in U.S. Pat. Nos. 4,334,012, 4,301,241 and 4,150,994. These grains can be used as seed crystals or can be effectively used when they are fed as silver halide for growth. In the latter case, it is preferred that the emulsion having a small grain size is added. The entire amount of the grains may be added initially, or the grains may be added in portions or continuously. It is often effective to add grains with various halogen compositions to modify the surface of-the grain.

Methods wherein most or a part of the halogen compositions of the silver halide grains is converted by a halogen conversion method, are described in U.S. Pat. Nos. 3,477,852 and 4,142,900, European Patents 273,429 and 273,430 and West German Patent Laid-Open No. 3,819,241. These methods are effective grain forming methods. A soluble halide solution or silver halide grains can be added to convert a soluble silver salt into a more difficultly soluble silver salt. The conversion may be made once, intermittently or continuously.

In addition to methods where grains are grown by adding a soluble silver salt and a soluble halide at a given concentration and at a given flow rate, methods where grains are formed by changing the concentration or the flow rate as described in U.K. Patent 1,469,480 and U.S. Pat. Nos. 3,650,757 and 4,242,455 are preferred as grain forming methods. The amount of silver halide to be fed can be changed linearly, quadratically or as a function of higher degree of addition time by increasing the concentration or the flow rate. A reduction in the amount of silver halide to be fed is often preferred. When two or more soluble silver salt solutions with different solution compositions or two or more soluble halide solutions with different solution compositions are added, an addition method wherein one of them is increased and the other is reduced, is an effective method.

Mixers for reacting a solution of a soluble silver salt with a solution of a soluble halide can be chosen from those described in U.S. Pat. Nos. 2,996,287, 3,342,605, 3,415,650 and 3,785,777 and West German Patent Laid-Open Nos. 2,556,885 and 2,555,364.

The use of silver halide solvents is effective in accelerating ripening. For example, it is known that an excess amount of a halogen ion is allowed to be present in the reactor to accelerate ripening. Other ripening agents can be used. All of the ripening agent may be added to a dispersion medium in the reactor before the silver salt and the halide are added. Alternatively, the ripening agent may be added to the reactor together with the addition of the halide, the silver salt or a deflocculant. In another embodiment, the ripening agent can be independently introduced at a stage in the addition of the halide and the silver salt.

Examples of the ripening agents include ammonia, thiocyanates (potassium thiocyanate, ammonium thiocyanate) and organic thioether compounds (e.g., compounds described in U.S. Pat. Nos. 3,574,628, 3,021,215, 3,057,724, 3,038,805, 4,276,374, 5,297,439, 3,704,130 and 4,732,013 and JP-A-57-104926); thione compounds (e.g., tetra-substituted thioureas described in JP-A-53-82408, JP-A-55-77737 and U.S. Pat. No. 4,221,863 and compounds described in JP-A-53-144319); mercapto compounds capable of accelerating the growth of silver halide grains described in JP-A-57-202531; and amine compounds (e.g., compounds described in JP-A-54100717).

Gelatin can be advantageously used as a protective colloid during the preparation of the emulsions of the present invention or as a binder for other hydrophilic colloid layers. However, other hydrophilic colloid can be used.

Examples of other hydrophilic colloid which can be used in the present invention include proteins such as gelatin derivatives, graft polymers of gelatin with other high-molecular weight materials, albumin and casein; cellulose derivatives such as hydroxyethyl cellulose, carboxymethyl cellulose and cellulose sulfate; sugar derivatives such as sodium alginate and starch derivatives; and various synthetic high-molecular weight materials such as homopolymers, for example, polyvinyl alcohol, polyvinyl alcohol partial acetal, poly-N-vinylpyrrolidone, polyacrylic acid, polymethacrylic acid, polyacrylamide, polyvinylimidazole, and polyvinylpyrazole and copolymers thereof.

Examples of gelatins which can be used include lime-processed gelatin, acid-processed gelatin and enzyme processed gelatin as described in *Bull. Soc. Sci. Photo. Japan.* No. 16, p. 30 (1966). Further, hydrolyzates and enzymatic hydrolyzates of gelatin can also be used.

It is preferred for the emulsions of the present invention to be washed with water for desalting. The rinsing temperature can be varied, but is preferably 5° to 50° C. The pH during rinsing can be also varied, but the pH is preferably 2 to 10, more preferably 3 to 8. The pAg during rinsing also can be varied depending on the purpose, but is preferably 5 to 10. Water washing can be achieved by noodle washing dialysis using a membrane, centrifugation, coagulative precipitation and ion exchange method. Examples of a coagulative precipitation method include a method using sulfates, a method using organic solvents, a method using water-soluble polymers and a method using gelatin derivatives.

It is preferred for metal salt ions to be present during the preparation of the emulsions of the present invention, for example, during the formation of the grains, desalting or chemical sensitization before coating. When grains are doped with the metal salts, the metal salts are added preferably during the formation of the grains, while when the metal salts are used as modifying agents for the surfaces of the grains or as chemical sensitizing agents, it is preferred that the metal salts are added after the formation of the grains, but before completion of chemical sensitization. All of the grain, only the core of the grain, only the shell of the grain, only the epitaxially grown part or only the substrate grain may be doped. Examples of metals for use in doping include Mg, Ca, Sr, Ba, Al, Sc, Y, LaCr, Mn, Fe, Co, Ni, Cu, Zn, Ga, Ru, Rh, Pd, Re, Os, Ir, Pt, Au, Cd, Hg, Tl, In, Sn, Pb, and Bi. These metals can be added when in the form of a salt which can be dissolved during the formation of the grains, such as an ammonium salt, an acetate, a nitrate, a sulfate, a phosphate, a hydroxide, a six-coordinate complex or a four-coordinate complex. Examples of these salts include $CdBr_2$, $CdCl_2$, $Cd(NO_3)_2$, $Pb(NO_3)_2$, $Pd(CH_3COO)_2$, $K_3[Fe(CN)_6]$, $(NH_4)_4[Fe(CN)_6]$, $K_3IrCl_6$, $(NH_4)_3RhCl_6$, $K_4Ru(CN)_6$. Ligands for coordination compounds can be chosen from among halogen, aquo, cyano, cyanate, thiocyanate, nitrosyl, thionitrosyl, oxo and carbonyl legands. These metal compounds may be used alone or as combination of two or more thereof.

It is preferred for the metal compounds to be dissolved in water or an appropriate solvent such as methanol or acetone and added. An aqueous solution of a hydrogen halide (e.g., HCl, HBr) or an alkali halide (e.g., KCl, NaCl, KBr, NaBr) may be added to stabilize the solution. If desired, an acid or an alkali may be added. The metal compounds may be added to the reactor before or during the formation of the grains. The metal compounds are added to an aqueous solution of a water-soluble silver salt (e.g., $AgNO_3$) or an alkali halide (e.g., NaCl, BBr, KI) and the mixture may be continuously added during the course of the formation of the silver halide grains. A solution of the metal compound is prepared and may be added at an appropriate stage during the formation of the grains. Further, combinations of various addition methods can be advantageously used.

The addition of chalcogenide compounds during the preparation of the emulsions as described in U.S. Pat. No. 3,772,031 is often useful. In addition to S, Se and Te, cyanates, thiocyanates, selenocyanates, carbonates, phosphates or acetates may be present.

It is preferred for the silver halide emulsions of the present invention to be subjected to reduction sensitization during the formation of the grains; or after the formation of the grains, but before or during chemical sensitization; or after chemical sensitization.

Examples of reduction sensitization include a method wherein a reduction sensitizing agent is added to the silver halide emulsions; a method wherein grains are grown or ripened at a low pAg of pAg=1 to 7 called silver ripening; and a method wherein grains are grown or ripened at a high pH of pH=8 to 11 called high pH ripening. Two or more of these methods may be used in combination, if desired.

Methods, wherein reduction sensitizing agents are added, are preferred from the standpoint of allowing the level of reduction sensitization to be finely controlled.

Examples of conventional reduction sensitizing agents which can be used in the present invention include stannous salts, ascorbic acid and derivatives thereof, amines and polyamines, hydrazine derivatives, formamidinesulfinic acid, silane compounds and borane compounds. Two or more compounds may be used in combination. Preferred reduction sensitizing agents include stannous chloride, thiourea dioxide, dimethylamineborane, ascorbic acid and derivatives thereof. The amount of the reduction sensitizing agent to be used varies depending on the preparation conditions of the emulsions, but is preferably $10^{-7}$ to $10^{-3}$ mol per mol of silver halide.

The reduction sensitizing agents are dissolved in water or solvents such as alcohols, glycols, ketones, esters or amides and added during the course of the growth of the grains. The agents may be previously added to the reaction vessel.

However, it is preferred that the agents are added at an appropriate stage during the growth of the grains. Reduction sensitizing agents are previously added to an aqueous solution of a water-soluble silver salt or a water soluble alkali halide, and silver halide grains may be precipitated by using the resulting aqueous solution. It is also preferred for a solution of the reduction sensitizing agent to be continuously added portionwise with the growth of the grains over a long period of time.

It is preferred that an oxidizing agent for silver is used during the preparation of the emulsions of the present invention. The term "oxidizing agent for silver" as used herein refers to a compound capable of reacting with metallic silver to convert it into silver ion. Compounds capable of converting very fine silver particles into silver ion are effective, these silver particles being concomitantly formed during the formation of the silver halide grains or chemical sensitization. The silver ion to be formed may be a silver salt which is difficultly soluble in water, such as silver halide, silver sulfide or silver selenide. Alternatively, a silver salt which is easily soluble in water, such as silver nitrate may be formed oxidizing agents for silver may be inorganic agents or organic agents. Examples of suitable inorganic oxidizing agents include ozoner hydrogen peroxide and adducts thereof (e.g., $NaBO_2 \cdot H_2O_2 \cdot 3H_2O$, $2NaCO_3 \cdot 3H_2O_2$, $Na_4P_2O_7 \cdot 2H_2O_2$, $2Na_2SO_4 \cdot H_2O_2 \cdot {}_2H_2O$), oxy acid salts such as salts of peroxy acids (e.g., $K_2S_2O_8$, $K_2C2O_6$, $K_2P2O_8$), peroxy complex compounds ( e.g., $K2[Ti(O_2)C_2O_4] \cdot 3H_2O$, $4K_2SO_4 \cdot Ti(O_2)OH \cdot SO_4 \cdot 2H_2O$, $Na3[VO(O_2)—(C_2H_4)_2 \cdot 6H_2O]$, permanganates (e.g., $KMnO_4$) and chromates (e.g., $K_2Cr_2O_7$), elemental halogens such as iodine and bromine, salts of perhalogenic acids (e.g., potassium periodate), polyvalent metal salts (e.g., potassium hexacyanoferrate(III) ) and thiosulfonates.

Examples of organic oxidizing agents include quinones such as p-quinone, organic peroxides such as peracetic acid and perbenzoic acid and compounds which release active halogen (e.g., N-bromosuccinimide, chloramine T, chloramine B) .

Of the above-described oxidizing agents, preferred inorganic oxidizing agents are ozone, hydrogen peroxide and derivatives thereof, elemental halogen and thiosulfonates, and preferred organic oxidizing agents are quinones. It is preferred that the above-described reduction sensitizing agent and oxidizing agent for silver are used in combination. A method wherein the oxidizing agent is used and then reduction sensitization is carried out; a method wherein reduction sensitization is carried out and then the oxidizing agent is used; and a method wherein both are present simultaneously can be used. These method may be carried out during the formation of the grain or during chemical sensitization.

It is preferred for the photographic emulsions of the present invention to be spectral-sensitized, because the effect of the present invention can be better exhibited. The dyes described above can be used.

These sensitizing dyes may be used either alone or in combination. Combinations of the sensitizing dyes are often used for the purpose of supersensitization. Typical examples of dyes are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301 3,814,609, 3,837,862 and 4,026,707, U.K. Patents 1,344,281 and 1,507,803, JP-B-43-4936, JP-B-53-12375, JP-A-52-110618 and JP-A-52-109925.

In addition to sensitizing dyes, the emulsions may contain a dye which itself does not have any spectral sensitization effect or a material which does not substantially absorb visible light, but exhibits a supersensitization effect.

Generally, the sensitizing dyes are added after completion of chemical sensitization, but before coating. However, the sensitizing dyes may be added simultaneously with the addition of the chemical sensitizing agents, and spectral sensitization and chemical sensitization may be simultaneously carried out as described in U.S. Pat. Nos. 3,628,969 and 4,225,666. Spectral sensitization may be carried out before chemical sensitization, or the sensitizing dyes can be added before completion of the formation of the silver halide grains, and then spectral sensitization is initiated as described in JP-A-58-113928. Further, these compounds can be added portionwise, namely, a part of these compounds is added before chemical sensitization and the remainder is added after chemical sensitization as described in U.S. Pat. No. 4,225,666.

The sensitizing dyes are used in an amount of preferably $4\times10^{-6}$ to $8\times10^{-3}$ mol per mol of silver halide. When the silver halide grains have a grain size of 0.2 to 1.2 μm, an amount of about $5\times10^{-5}$ to $2\times10^{-3}$ mol per mol of silver halide is especially effective.

The photographic materials of the present invention may contain the above described various additives. In addition, other additives may be used depending on the purpose.

These additives are described in *Research Disclosure*, No. 17643 (1978), ibid., No. 18716 (November 1979) and ibid., No. 307105 (November 1989), and the locations of these disclosures are further indicated in the table given hereinafter.

A photographic material of the present invention should have, on a support, at least one blue sensitive silver halide emulsion layer, at least one green sensitive silver halide emulsion layer and at least one red sensitive silver halide emulsion layer, but no particular limitation is imposed upon the number or order of the silver halide emulsion layers and non-photosensitive layers. Typically, a silver halide photographic material has, on a support, at least one photosensitive layer comprising a plurality of silver halide emulsion layers which have essentially the same color sensitivity but different photographic speeds, these photosensitive layers being a unit photosensitive layer which is color sensitive to blue light, green light or red light. In a multi-layer silver halide color photographic material the arrangement of the unit photosensitive layers generally involves their establishment in the order, from the support side, of a red sensitive layer, a green sensitive layer, a blue sensitive layer. However, this order may be changed, as required, and the layers may be arranged in such a way that a layer which has a different color sensitivity is sandwiched between layers which have the same color sensitivity.

Various non-photosensitive layers, such as intermediate layers, may be positioned between the above described silver halide! photosensitive layers, and as the uppermost and lowermost layers.

These intermediate layers may contain couplers and DIR compounds such as those disclosed in the specifications of JP-A-61-43748, JP-A-59-113438, JP-A-59-113440, JP-A-61-20037 and JP-A-61-20038, and they may also contain anti-color mixing compounds which are generally used.

The plurality of silver halide emulsion layers constituting each unit photosensitive layer preferably comprises a double layer structure of a high speed emulsion layer and a low speed emulsion layer as disclosed in West German Patent 1,121,470 or British Patent 923,045. Generally, arrangements in which the photographic speed is lower in the layer closer to the support are preferred, and non-photosensitive layers may be positioned between each of the silver halide emulsion layers. Furthermore, the low speed layers may be arranged on the side furthest away from the support and the high speed layers may be arranged on the side closest to the support as disclosed, for example, in JP-A-57-112751, JP-A-62-200350, JP-A-62-206541 and JP-A-62-206543.

In practical terms, the arrangement may be, from the side furthest from the support as follows: low speed blue sensitive layer (BL)/high speed blue sensitive layer (BH)/high speed green sensitive layer (GH)/low speed green sensitive layer (GL)/high speed red sensitive layer (RH)/low speed red sensitive layer (RL); or BH/BL/GL/GH/RH/RL; or BH/BL/GH/GL/RL/RH.

Furthermore, the layers can be arranged in the order, from the side furthest from the support, of blue sensitive layer/GH/RH/GL/RL as disclosed in JP-B-5534932. Furthermore, the layers can also be arranged in the order, from the side furthest away from the support, of blue sensitive layer/GL/RL/GH/RH, as disclosed in the specifications of JP-A-56-25738 and JP-A-62-63936.

Furthermore, arrangements in which there are three layers which have different speeds with the photosensitivity decreases towards the support with the silver halide emulsion layer of the highest photosensitivity at the top, a silver halide emulsion layer which has a lower photosensitivity than the aforementioned layer as an intermediate layer and a silver halide emulsion layer which has a lower photosensitivity than the intermediate layer as a bottom layer, as disclosed in JP-B-49-15495 can be used. With structures of this type which have three layers with different photosensitivities, the layers in a layer of the same color sensitivity may be arranged in the order, from the side furthest from the support, of intermediate speed emulsion layer/high speed emulsion layer/low speed emulsion layer, as disclosed in the specification of JP-A-59-202464.

Furthermore, the layers can be arranged in the order of high speed emulsion layer/low speed emulsion layer/intermediate speed emulsion layer, or low speed emulsion layer/intermediate speed emulsion layer/high speed emulsion layer, for example. Furthermore, the arrangement may be varied as indicated above in cases where there are four or more layers.

As described above, various layer structures and arrangements can be selected depending on the purpose of the photosensitive material.

Preferred silver halides for inclusion in the photographic emulsion layers of a photographic material used in the present invention are silver iodobromides, silver iodochlorides or silver iodochlorobromides which contain not more than about 30 mol % of silver iodide. Most desirably, the silver halide is a silver iodobromide or silver iodochlorobromide which contains from about 2 mol % to about 10 mol % of silver iodide.

The silver halide grains in the photographic emulsion may have a regular crystalline form such as a cubic, octahedral or tetradecahedral form, an irregular crystalline form such as a spherical or plate-like form, a form which has crystal defects such as twinned crystal planes, or a form which is a composite of these forms.

The grain size of the silver halide may be very fine of about 0.2 microns or less, or large with a projected area diameter of up to about 10 microns, and the emulsions may be polydisperse emulsions or monodisperse emulsions.

Silver halide photographic emulsions which can be used in the present invention can be prepared, for example, using the methods disclosed in *Research Disclosure* (RD) No. 17643 (December, 1978), pages 22–23, "I. Emulsion Preparation and Types", *Research Disclosure*, No. 18716 (November 1979), page 648, and *Research Disclosure*, No. 307105 (November 1989), pages 863–865, in P. Glafkides, *Chimie et Physique Photographique*, published by Paul Montel, 1967, in G. F. Duffin in *Photographic Emulsion Chemistry*, published by Focal Press, 1966, and in V. L. Zelikmann et al, *Making and Coating Photographic Emulsions*, published by Focal Press, 1964.

The monodisperse emulsions disclosed, for example, in U.S. Pat. Nos. 3,574,628 and 3,655,394, and in British Patent 1,413,748, are also desirable.

Furthermore, tabular grains which have an aspect ratio of at least about 3 can also be used in the present invention. Tabular grains can be prepared easily using the methods described, for example, in Gutoff, *Photographic Science and Engineering*, Volume 14, pages 248–257 (1970), and in U.S. Pat. Nos. 4,434,226, 4,414,310, 4,433,048 and 4,439,520, and British Patent 2,112,157.

The crystal structure may be uniform, or the interior and exterior parts of the grains may have different halogen compositions, or the grains may have a layer-like structure and, moreover, silver halides which have different compositions may be joined with an epitaxial junction or they may be joined with compounds other than silver halides, such as silver thiocyanate or lead oxide, for example. Furthermore, mixtures of grains which have various crystalline forms may be used.

The above mentioned emulsions may be of the surface latent image type with which the latent image is formed principally on the surface, the internal latent image type in which the latent image is formed within the grains, or of a type in which the latent image is formed both at the surface and within the grains. Internal latent image type emulsions may also be a core/shell internal latent image type emulsion as disclosed in JP-A-63-264740. A method for the preparation of such a core/shell internal latent image type emulsion is disclosed in JP-A-59-133542. The thickness of the shell of this emulsion differs depending on the development processing, for example, but is preferably from 3 to 40 nm, and most desirably from 5 to 20 nm.

The silver halide emulsions used have generally been subjected to physical ripening, chemical ripening and spectral sensitization. Additives which are used in such processes have been disclosed in *Research Disclosure* Nos. 17643, 18716 and 307105, and the locations of these disclosures are summarized in the table provided hereinafter.

Two or more different types of emulsion which differ in terms of at least one of the characteristics of grain size, grain size distribution, halogen composition of the photosensitive silver halide emulsion, the grain form or photographic speed can be used in the form of a mixture in the same layer in a photographic material of the present invention.

The use of essentially non-photosensitive hydrophilic colloid layers and/or photosensitive silver halide emulsion layers containing silver halide grains in which the grain surface has been fogged as disclosed in U.S. Pat. No. 4,082,553, silver halide grains in which the grain interior has been fogged as disclosed in U.S. Pat. No. 4,626,498 and JP-A-59-214852 or colloidal silver is desirable. Silver halide grains of which the grain interior or surface has been fogged are silver halide grains which can be developed uniformly (not in the form of the image) irrespective of whether they are in an unexposed area or an exposed area of the photographic material. Methods for the preparation of silver halide grains in which the interior or surface of the grains has been fogged are disclosed in U.S. Pat. No. 4,626,498 and JP-A-59-214852.

The silver halide in which the internal nuclei of a core/shell type silver halide grain in which the grain interior has been fogged are formed may have the same halogen composition or a different halogen composition. The silver halide in which the interior or surface of the grains has been fogged may be a silver chloride, a silver chlorobromide, a silver iodobromide or a silver chloroiodobromide. No particular limitation is imposed upon the grain size of these fogged silver halide grains, but an average grain size of from 0.01 to 0.75 μm, and especially of from 0.05 to 0.6 μm, is preferred. Furthermore, no particular limitation is imposed upon the form of the grains and they may be regular grains, and they may be polydisperse emulsions, but monodisperse emulsions (in which at least 95% in terms of the weight or number of silver halide grains have a grain size within ±40% of the average grain size) are preferred.

The use of non-photosensitive fine grain silver halides is desirable in the present invention. Non-photosensitive fine grain silver halides are fine grain silver halides which are not photosensitive at the time of imagewise exposure for obtaining the dye image and which undergo essentially no development during development processing, and those which have not been prefogged are preferred.

The fine grain silver halide has a silver bromide content from 0 to 100 mol %, which may contain silver chloride and/or silver iodide if required. Those which have a silver iodide content of from 0.5 to 10 mol % are preferred.

The fine grain silver halide has an average grain size (the average value of the diameters of the circles corresponding to the projected areas) preferably of from 0.01 to 0.5 μm, and most desirably of from 0.02 to 0.2 μm.

The fine grain silver halide can be prepared using the same methods as used in general for the preparation of photosensitive silver halides. In this case, the surface of the silver halide grains does not need to be optically sensitized and neither is there any need for spectral sensitization. However, the preaddition of known stabilizers such as triazole, azaindene, benzothiazolium or mercapto based compounds or zinc compounds before addition to the coating liquid is desirable. Colloidal silver can also be included desirably in the layer which contains these fine grain silver halide grains.

The coated weight of silver in a photographic material of the present invention is preferably 6.0 g/m$^2$ or less, and most desirably 4.5 g/m$^2$ or less.

Known photographically useful additives which can be used in the present invention are disclosed in the *Research Disclosures* referred to above, and the locations of these disclosures are further indicated in the table below.

| Type of Additive | RD17643 (December 1978) | RD18716 (November 1979) | RD307105 (November 1989) |
|---|---|---|---|
| 1. Chemical Sensitizers | Page 23 | Page 648, right hand column | Page 866 |
| 2. Speed Increasing Agents | | Page 648, right hand column | |
| 3. Spectral Sensitizers, Super-Sensitizers | Pages 23–24 | Page 648 right hand column - page 649 right hand column | Pages 866–868 |
| 4. Whitening Agents | Page 24 | Page 647 | Page 868 |
| 5. Anti-Foggants, Stabilizers | Pages 24–25 | Page 649, right hand column | Pages 868–870 |
| 6. Light Absorbers, Filter Dyes and Ultraviolet Absorbers | Pages 25–26 | Page 649, right hand column - page 650, left hand column | Page 873 |
| 7. Anti-Staining Agents | Page 25, right hand column | Page 650, left hand column - right hand column | Page 872 |
| 8. Dye Image Stabilizers | Page 25 | page 650, left hand column | Page 872 |
| 9. Film Hardening Agents | Page 26 | Page 651, left hand column | Pages 874–875 |
| 10. Binders | Page 26 | Page 651, left hand column | Pages 873–874 |
| 11. Plasticizers, Lubricants | Page 27 | Page 650, right hand column | Page 876 |
| 12. Coating Aids Surfactants | Pages 26–27 | Page 650, right hand column | Pages 875–876 |
| 13. Anti-Static Agents | Page 27 | Page 650, right hand column | Pages 876–877 |
| 14. Matting Agents | | | Pages 878–879 |

Furthermore, the addition of compounds which can react with and fix formaldehyde, as disclosed in U.S. Pat. Nos. 4,411,987 and 4,435,503, to the photographic material is desirable for preventing deterioration of photographic performance due to formaldehyde gas.

The inclusion of mercapto compounds such as those disclosed in U.S. Pat. Nos. 4,740,454 and 4,788,132, JP-A-62-18539 and JP-A-1-283551 in a photographic material of the present invention is also desirable.

The inclusion of compounds which release fogging agents, development accelerators, silver halide solvents or precursors of these materials irrespective of the amount of developed silver produced by development processing (i.e., compounds such as disclosed in JP-A-1106052) in a photographic material of the present invention is also desirable.

The inclusion of the dyes dispersed using the methods disclosed in International Patent laid open W088/04794 and JP-A-1-502912, and the dyes disclosed in EP 317,308A, U.S. Pat. No. 4,420,555 and JP-A-1-259358 in a photographic material of the present invention is desirable.

Various color couplers can be used in the present invention, and actual examples are disclosed in the patents cited in the above-described *Research Disclosure* No. 17643, sections VII-C–G, and No. 307105, sections VII-C–G.

Those yellow couplers disclosed, for example, in U.S. Pat. Nos. 3,933,501, 4,022,620, 4,326,024, 4,401,752 and 4,248,961, JP-B-58-10739, British Patents 1,425,020 and 1,467,760, U.S. Pat. Nos. 3,973,968, 4,314,023 and 4,511,649, and European Patent 249,473A are preferred.

5-Pyrazolone based compounds and pyrazoloazole based compounds are preferred as magenta couplers, and those disclosed, for example, in U.S. Pat. Nos. 4,310,619 and 4,351,897, European Patent 73,636, U.S. Pat. Nos. 3,061,432 and 3,725,067, *Research Disclosure*, No. 24220 (June 1984), JP-A-60-33552, *Research Disclosure*, No. 24230 (June 1984), JP-A-60-43659, JP-A-61-72238, JP-A-60-35730, JP-A-55-118034, JP-A-60-185951, U.S. Pat. Nos. 4,500,630, 4,540,654 and 4,556,630, and International Patent WO 88/04795 are especially desirable.

Phenol based and naphthol based couplers can be employed as cyan couplers, and those disclosed, for example, in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Laid Open 3,329,729, European Patents 121, 365A and 249,453A, U.S. Pat. Nos. 3,446,622, 4,333,999, 4,775,616, 4,451,559, 4,427,767, 4,690,889, 4,254,212 and 4,296,199, and JP-A-61-42658 are preferred.

Typical examples of polymerized dye forming couplers are disclosed, for example, in U.S. Pat. Nos. 3,451,820, 4,080,211, 4,367,282, 4,409,320 and 4,576,910, British Patent 2,102,137 and European Patent 341,188A.

The couplers disclosed in U.S. Pat. No. 4,366,237, British Patent 2,125,570, European Patent 96,570 and West German Patent (Laid Open) 3,234,533 are preferred as couplers in which the colored dyes have a suitable degree of diffusibility.

The colored couplers for correcting the unwanted absorptions of colored dyes disclosed, for example, in section VII-G of *Research Disclosure*, No. 17643, section VII-G of *Research Disclosure*, No. 307105, U.S. Pat. No. 4,163,670, JP-B-57-39413, U.S. Pat. Nos. 4,004,929 and 4,138,258, and British Patent 1,146,368 are preferred. Furthermore, the use of couplers which correct the unwanted absorption of colored dyes by means of fluorescent dyes which are released on coupling as disclosed in U.S. Pat. No. 4,774,181, and couplers which have, as coupling-off groups, dye precursor groups which form dyes on reaction with the oxidation product of the developing agent as disclosed in U.S. Pat. No. 4,777,120 is also desirable.

The use of couplers which release photographically useful residual groups on coupling is also desirable in the present invention. DIR couplers which release development inhibitors disclosed in the patents cited in section VII-F of *Research* Disclosure, No. 17643, section VII-F of *Research Disclosure*, No. 307105, JP-A-57-151944, JP-A-57-154234, JP-A-60-184248, JP-A-6337346, JP-A-63-37350 and U.S. Pat. Nos. 4,248,962 and 4,782,012 are preferred.

The couplers disclosed in British Patents 2,097,140 and 2,131,188, JP-A-59-157638 and JP-A-59-170840 are preferred as couplers which release nucleating agents or development accelerators in relation to the image formed during development. Furthermore, compounds which release fogging agents, development accelerators, silver halide solvents etc. by means of a redox reaction with the oxidation product of a developing agent disclosed in JP-A-60-107029, JP-A-60252340, JP-A-1-44940 and JP-A-1-45687 are also desirable.

Other compounds which can be used in the photographic materials of the present invention include; the competitive couplers disclosed, for example, in U.S. Pat. No. 4,130,427; the multi-equivalent couplers disclosed, for example, in U.S. Pat. Nos. 4,283,472, 4,338,393 and 4,310,618; the DIR redox compound releasing couplers, DIR coupler releasing couplers, DIR coupler releasing redox compounds or DIR redox releasing redox compounds disclosed, for example, in JP-A-60185950 and JP-A-62-24252; couplers which release dyes where the color is restored after elimination, such as disclosed in European Patents 173,302A and 313,308A; bleach accelerator releasing couplers disclosed, for example, in *Research Disclosure*, No. 11449, ibid, No. 24241, and JP-A-61-201247; ligand releasing couplers disclosed, for example, in U.S. Pat. No. 4,555,477; leuco dye releasing couplers such as disclosed in JP-A-6375747; and couplers which release fluorescent dyes such as disclosed in U.S. Pat. No. 4,774,181.

The couplers used in the present invention can be introduced into the photographic materials using a variety of known methods.

Examples of high boiling point solvents which can be used in an oil in water dispersion method are disclosed, for example, in U.S. Pat. No. 2,322,027.

Specific examples of high boiling point organic solvents which have a boiling point of at least 175° C. at normal pressure which can be used in the oil-in-water dispersion method include phthalic acid esters (for example, dibutyl phthalate, dicyclohexyl phthalate, di2-ethylhexyl phthalate, decyl phthalate, bis(2,4-ditert-amylphenyl)phthalate, bis(2,4-di-tert-amylphenyl)isophthalate and bis(1,1-diethylpropyl)phthalate), phosphoric acid or phosphonic acid esters (for example, triphenyl phosphate, tricresyl phosphate, 2-ethylhexyl diphenyl phosphate, tricyclohexyl phosphate, tri-2-ethylhexyl phosphate, tridodecyl phosphate, tributoxyethyl phosphate, trichloropropyl phosphate and di-2-ethylhexyl phenyl phosphonate), benzoic acid esters (for example, 2-ethylhexyl benzoate, dodecyl benzoate, 2-ethylhexyl p-hydroxybenzoate), amides (for example, N,N-diethyldodecanamide, N,N-diethyllaurylamide and N-tetradecylpyrrolidone), alcohols or phenols (for example, isostearyl alcohol and 2,4-di-tert-amylphenol), aliphatic carboxylic acid esters (for example, bis(2-ethylhexyl)sebacate, dioctyl azelate, glycerol tributyrate, iso-stearyl lactate and trioctyl citrate), aniline derivatives (for example, N,N-dibutyl-2-butoxy-5-tert-octylaniline) and hydrocarbons (for example, paraffins, dodecylbenzene and di-isopropylnaphthalene). Furthermore, organic solvents which have a boiling point of about 30° C. or above, and preferably of 50° C. or above, but below about 160° C. can be used as auxiliary solvents. Typical examples of these solvents include ethyl acetate, butyl acetate, ethyl propionate, methyl ethyl ketone, cyclohexanone, 2-ethoxyethyl acetate and dimethylformamide.

The processes and effects of the latex dispersion method and actual examples of latexes for loading purposes are disclosed, for example, in U.S. Pat. No. 4,199,363, and in West German Patent Applications (OLS) 2,541,274 and 2,541,230.

The addition to the color photographic materials of the present invention of various fungicides and biocides such as phenethyl alcohol or 1,2-benzisothiazolin-3-one, n-butyl p-hydroxybenzoate, phenol, 4-chloro-3,5-dimethylphenol, 2-phenoxyethanol and 2-(4-thiazolyl)benzimidazole for example as disclosed in JP-A-63-257747, JP-A-62-272248 and JP-A-1-80941 is desirable.

The present invention can be used for a variety of color photographic materials. Typical examples include color negative films for general and cinematographic purposes, color reversal films for slides and television purposes, color papers, color positive films and color reversal papers.

Suitable supports which can be used in the present invention are disclosed, for example, on page 28 of *Research Disclosure*, No. 17643, from the right hand column of page 647 to the left hand column of page 648 of *Research Disclosure*, No. 18716, and on page 879 of *Research Disclosure*, No. 307105.

The photographic materials of the present invention are such that the total film thickness of all the hydrophilic colloid layers on the side where the emulsion layers are located is preferably 28 μm or less, more desirably 23 μm or less, even more desirably 18 μm or less, and most desirably 16 μm or less. Furthermore, the film swelling rate $T_{1/2}$ is preferably not more than 30 seconds and most desirably not more than 20 seconds. Here, the film thickness signifies the film thickness measured under conditions of 25° C., 55% relative humidity (2 days) and the film swelling rate $T_{1/2}$ is that measured using the methods well known to those in the industry. For example, measurements can be made using a swellometer of the type described in A. Green, *Photogr. Sci. Eng.*, Volume 19, Number 2, pages 124–129, and $T_{1/2}$ is defined as the time taken to reach half the saturated film thickness, taking 90% of the maximum swollen film thickness reached on processing the material for 3 minutes 15 seconds in a color developer at 30° C. as the saturated film thickness.

The film swelling rate $T_{1/2}$, can be adjusted by adding film hardening agents for the gelatin which is used as a binder, or by changing the ageing conditions after coating. Furthermore, a swelling factor of from 150% to 400% is preferred. The swelling factor can be calculated from the maximum swelled film thickness obtained under the conditions described above using the expression (maximum swelled film thickness minus film thickness)/film thickness.

The establishment of a hydrophilic colloid layer (known as a backing layer) of a total dry film thickness of from 2 μm to 20 μm on the opposite side from the emulsion layers is desirable in a photographic material of the present invention. The inclusion of the above described light absorbing agents, filter dyes, ultraviolet absorbers, anti-static agents, film hardening agents, binders, plasticizers, lubricants, coating promoters and surfactants, for example, in this backing layer is desirable. The swelling factor of the backing layer is preferably from 150% to 500%.

Color photographic materials in accordance with the present invention can be developed and processed using the general methods disclosed on pages 28–29 of *Research Disclosure*, No. 17643, from the left hand column to the right hand column of page 615 of *Research Disclosure*, No. 18716, and on pages 880 to 881 of *Research Disclosure*, No. 307105.

The color developers used for the development processing of photographic materials of the present invention are preferably aqueous alkaline solutions which contain a primary aromatic amine based color developing agent as the principal component. Aminophenol based compounds are also useful as color developing agents, but the use of p-phenylenediamine based compounds is preferred, and typical examples include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-β-methoxyethylaniline, and the sulfate, hydrochloride and p-toluenesulfonate salts of these compounds. Of these compounds, 3-methyl-4-amino-N-ethyl-N-β-hydroxyethylaniline sulfate is especially desirable. Two or more of these compounds can be used in combination, depending on the intended purpose.

The color developer generally contains pH buffers such as alkali metal carbonates, borates or phosphates, and development inhibitors or anti-foggants such as chloride, bromide, iodide, benzimidazoles, benzothiazoles or mercapto compounds. They may also contain, as necessary, various preservatives such as hydroxylamine, diethylhydroxylamine, sulfite, hydrazines such as N,N-biscarboxymethylhydrazine, phenylsemicarbazides, triethanolamine and catecholsulfonic acids, organic solvents such as ethylene glycol and diethylene glycol, development accelerators such as benzyl alcohol, polyethylene glycol, quaternary ammonium salts and amines, dye forming couplers, competitive couplers, auxiliary developing agents such as 1-phenyl-3-pyrazolidone, thickeners and various chelating agents as exemplified by aminopolycarboxylic acids, aminopolyphosphonic acids, alkylphosphonic acids and phosphonocarboxylic acids, typical examples of which include ethylenediaminetetraacetic acid, nitrilotriacetic acid, diethylenetriaminepentaacetic acid, cyclohexanediaminetetraacetic acid, hydroxyethyl iminodiacetic acid, 1-hydroxyethylidene-1,1 -diphosphonic acid, nitrilo-N,N,N-trimethylenephosphonic acid, ethylenediamine-N,N,N,N-tetramethylenephosphonic acid, ethylenediamine-di(o-hydroxyphenylacetic acid) and salts of these acids.

Furthermore, color development can be carried out after a normal black and white development in the case of reversal processing. Known black and white developing agents including dihydroxybenzenes such as hydroquinone, 3-pyrazolidones such as 1-phenyl-3-pyrazolidone, and aminophenols such as N-methyl-p-aminophenol, for example, can be used individually, or in combinations, in the black and white developer.

The pH of these color developers and black and white developers is generally from 9 to 12. Furthermore, the replenishment rate for these developers depends on the color photographic material which is being processed but, in general, it is 3 liters or less per square meter of photosensitive material, and it can be set to 500 ml or less by reducing the bromide ion concentration in the replenisher. Where the replenishment rate is low, it is desirable that evaporation and aerial oxidation of the liquid should be prevented by minimizing the area of contact with the air in the processing tank.

The contact area between the air and the photographic processing bath in a processing tank can be represented by the open factor which is defined below.

$$\text{Open Factor} = \frac{\text{Processing Bath and Air Contact Area (cm}^2\text{)}}{\text{Processing Bath Volume (cm}^3\text{)}}$$

The above described open factor is preferably not more than 0.1, and most desirably from 0.001 to 0.05. Moreover, the establishment of a shielding material such as a floating lid, for example, on the surface of the photographic processing bath in the processing tank, the method involving the use of a movable lid as disclosed in JP-A-1-82033 and the method involving the slit development processing disclosed in JP-A-63-216050 can be used to reduce the open factor. Reduction of the open factor is preferably applied not only to the color development and black and white development but also to all the subsequent processes, such as the bleaching, bleach-fixing, fixing, water washing and stabilizing processes. Furthermore, the replenishment rate can be reduced by using means for suppressing the accumulation of bromide ion in the development bath.

The color development processing time is generally between 2 and 5 minutes, but shorter processing times can be achieved by increasing the pH or by increasing the concentration of the color developing agent.

The photographic emulsion layer is generally subjected to a bleaching process after color development. The bleaching process may be carried out at the same time as a fixing process (i.e., a bleach-fix process) or it may be carried out separately. Moreover, a bleach-fix process can be carried out after a bleaching process in order to speed up processing. Moreover, processing can be carried out in two connected bleach-fix baths, a fixing process can be carried out before a bleach-fixing process or a bleaching process can be carried out after a bleach-fix process, as desired. Compounds of multi-valent metals, such as iron(III) for example, peracids, quinones and nitro compounds can be used as bleaching agents. Typical bleaching agents include organic complex salts of iron(III), for example, complex salts with aminopolycarboxylic acids such as ethylenediaminetetraacetic acid, diethylenetriaminepentaacetic acid, cyclohexanediaminetetraacetic acid, methylimino diacetic acid, 1,3-diaminopropanetetraacetic acid and glycol ether diaminetetraacetic acid, or citric acid, tartaric acid or malic acid. Of these materials, polyaminocarboxylic acid iron(III) complex salts, and principally ethylenediaminetetraacetic acid iron(III) complex salts and 1,3-diaminopropanetetraacetic acid iron(III) salts, are preferred from the standpoint of both rapid processing and the prevention of environmental pollution. Moreover, aminopolycarboxylic acid iron(III) complex salts are especially useful in both bleach baths and bleach-fix baths. The pH of the bleach baths and bleach-fix baths in which these aminopolycarboxylic acid iron(III) salts are present is generally from 4.0 to 8, but lower pH's can be used in order to speed up processing.

Bleaching accelerators can be used, as desired, in the bleach baths, bleach-fix baths or bleach or bleach-fix prebaths. Actual examples of useful bleach accelerators are disclosed in the art as follows: the compounds which have a mercapto group or a disulfide group disclosed, for example, in U.S. Pat. No. 3,893,858, West German Patents 1,290,812 and 2,059,988, JP-A-5332736, JP-A-53-57831, JP-A-53-37418, JP-A-53-72623, JPA-53-95630, JP-A-53-95631, JP-A-53-104232, JP-A-53124424, JP-A-53-141623, JP-A-53-28426, and *Research Disclosure*, No. 17129 (June 1978); the thiazolidine derivatives disclosed in JP-A-50-140129; the thiourea derivatives disclosed in JP-B-45-8506, JP-A-52-20832, JP-A-53-32735 and U.S. Pat. No. 3,706,561, the iodides disclosed in West German Patent 1,127,715 and JP-A-5816235; the polyoxyethylene compounds disclosed in West German Patents 966,410 and 2,748,430; the polyamine compounds disclosed in JP-B-45-8836; the other compounds disclosed in JP-A-49-40943, JP-A-49-59644, JP-A-5394927, JP-A-54-35727, JP-A-55-26506 and JP-A-58-163940; and the bromide ion. Of these compounds, those which have a mercapto group or a disulfide group are preferred from the standpoint of their large accelerating effect, and the compounds disclosed in U.S. Pat. No. 3,893,858, West German Patent 1,290,812 and JP-A-53-95630 are especially desirable. Moreover, the compounds disclosed in U.S. Pat. No. 4,552,834 are also desirable. These bleaching accelerators may be added to the photographic materials. These bleaching accelerators are especially effective when bleach-fixing color photographic materials for camera use.

The inclusion of organic acids as well as the compounds indicated above in the bleach baths and bleach-fix baths is desirable to prevent bleach staining. Compounds which have an acid dissociation constant (pKa) of from 2 to 5 are especially desirable for the organic acids, and in practice acetic acid and propionic acid, for example, are preferred.

Thiosulfate, thiocyanate, thioether based compounds, thioureas and large amounts of iodide can be used, for example, as the fixing agent in a fixing bath or bleach-fix bath, but thiosulfate is generally used, and ammonium thiosulfate in particular can be used in the widest range of applications. Furthermore, the combined use of thiosulfate and thiocyanate, thioether compounds, thiourea etc. is also desirable. Sulfite, bisulfite, carbonyl/bisulfite addition compounds or the sulfinic acid compounds disclosed in European Patent 294,769A are preferred as preservatives for fixing baths and bleach-fix baths. Moreover, the addition of various aminopolycarboxylic acids and organophosphonic acids to the fixing baths and bleach-fixing baths is desirable to stabilize these baths.

The addition of compounds with a pKa from 6.0 to 9.0, and preferably imidazoles such as imidazole, 1-methylimidazole, 1-ethylimidazole and 2-methylimidazole, in amounts of from 0.1 to 10 mol/liter to the fixing bath or bleach-fixing baths is desirable in the present invention.

A shorter total de-silvering processing time within the range where de-silvering failure does not occur is preferred. The de-silvering time is preferably from 1 to 3 minutes, and most desirably from 1 to 2 minutes. Furthermore, the processing temperature is from 25° C. to 50° C., and preferably from 35° C. to 45° C. The de-silvering rate is improved and staining after processing is effectively prevented within the preferred temperature range.

Agitation as strongly as possible during the desilvering process is desirable. Actual examples of methods to achieve strong agitation include methods in which a jet of processing liquid is impinged on the emulsion surface of the photographic material as disclosed in JP-A-62-183460, the method in which the agitation effect is increased using a rotary device as disclosed in JP-A-62-183461, the method in which the photographic material is moved with a wiper blade which is present in the bath in contact with the emulsion surface and the agitation effect is increased by the generation of turbulence at the emulsion surface, and the method in which the circulating flow rate of the processing bath as a whole is increased. These means of increasing agitation are effective for bleach baths, bleach-fix baths and fixing baths. It is thought that increased agitation increases the rate of supply of bleaching agent and fixing agent to the emulsion film and consequently increases the de-silvering rate. Furthermore, the above-described means of increasing agitation are more effective where a bleaching accelerator is used, and they sometimes provide a marked increase in the accelerating effect and eliminate the fixer inhibiting action of the bleaching accelerator.

Automatic processors which can be used for the photosensitive materials of the present invention preferably include photographic material transporting devices as disclosed in JP-A-60-191257, JP-A-60-191258 or JP-A-60-191259. With a transporting device, such as that disclosed in the aforementioned JP-A-60-191257, carry-over of processing liquid from one bath to the next is greatly reduced and this is very effective for preventing a deterioration in processing bath performance. These effects are especially useful to shorten the processing time in each process and to reduce the replenishment rate of each processing bath.

The silver halide color photographic materials of this invention are generally subjected to a water washing process and/or stabilizing process after the desilvering process. The amount of wash water used in the washing process can be varied over a wide range, depending on the application and the nature (the materials such as couplers which are used for example) of the photographic material, the wash water temperature, the number of water washing tanks (the number of water washing stages) and the replenishment system, i.e., whether a counter flow or a sequential flow system is used, and various other conditions. The relationship between the amount of water used and the number of washing tanks in a multi-stage counterflow system can be obtained using the method outlined on pages 248–253 of the *Journal of the Society of Motion Picture and Television Engineers*, Volume 64 (May 1955).

According to the multistage counterflow system described in the above reference, although the requisite amount of water can be greatly reduced, bacteria still grow due to an increase of the residence time of the water in the tank, and floating masses of bacteria adhere to the light-sensitive material. In the present invention, in order to cope with this problem, the method of reducing calcium and magnesium ion concentrations described in JP-A-62-288838 can be used very effectively. Further, isothiazolone compounds or thiabendazoles (as disclosed in JP-A-57-8542), chlorine type bactericides (e.g., chlorinated sodium isocyanurate, benzotriazole), and bactericides (as described in Hiroshi Horiguchi, *Bokin Bobaizai no Kagaku* (*Chemistry of Bactericidal and Fungicidal Agent*), Sankyo Shuppan (1986); Association of Sanitary Technique (ed.), *Biseibutsu no Mekkin, sakkin, Bobaiqijutsu* (*Bactericidal and Fungicidal Techniques to Microorganisms*), published by Association of Engineering Technology (1982) and Nippon Bactericidal and Fungicidal Association (ed.), *Bokin Bobaizai jiten* (*Encyclopedia of Bactericidal and Fungicidal Agents*) (1986) can also be effectively used.

The washing water has a pH of from 4 to 9, preferably from 5 to 8. The temperature of the water and the washing time can be selected over a broad range depending on the characteristics and end use of the light-sensitive material, but usually ranges from 15° to 45° C. in temperature and from 20 seconds to 10 minutes in time, preferably from 25° to 40° C. in temperature and from 30 seconds to 5 minutes. The photographic material of the present invention may be directly processed with a stabilizer in place of the washing step. Any of the known techniques described in JP-A-57-8543, JP-A-5814834, and JP-A-60-220345 can be used for stabilization.

If used, the washing step may be followed by stabilization. For example, a stabilizing bath containing a dye stabilizer and a surface active agent can be used as a final bath for color light-sensitive photographic materials for camera use. Examples of suitable dye stabilizers include aldehydes (such as formaldehyde and glutaraldehyde), N-methylol compounds, hexamethylenetetramine, and aldehydesulfite adducts.

The stabilizing bath may also contain various chelating agents or bactericides.

The overflow accompanying replenishment of the washing bath and/or stabilizing bath can be reused in other steps such as desilvering, if desired.

In processing using an automatic developing machine, if the processing solutions become concentrated due to evaporation, water is preferably supplied to the system to maintain the proper concentration.

The silver halide color photographic material of the present invention may contain a color developing agent for the purpose of simplifying and expediting processing. Such a color developing agent is preferably used in the form of a precursor. Examples of such precursors include indoaniline compounds (as disclosed in U.S. Pat. No. 3,342,597); Schiff's base type compounds (as disclosed in U.S. Pat. No. 3,342,599, and *Research Disclosure*, Nos. 14850 and 15159); aldol compound (as disclosed in *Research Disclosure*, No. 13942); metal complexes (as disclosed in U.S. Pat. No. 3,719,492); and urethane compounds (as disclosed in JP-A-53-135628).

The silver halide color photographic material of the present invention may optionally comprise various 1-phenyl-3-pyrazolidones for the purpose of accelerating color development. Typical examples of such compounds are disclosed in JP-A-56-64339, JP-A-57-144547, and JPA-58-115438.

In the present invention various processing solutions are used at a temperature of from 10° C. to 50° C. The standard temperature ranges is normally from 33° C. to 38° C. However, a higher temperature range can be used to accelerate processing, thus reducing the processing time. Alternatively, a lower temperature range can be used to improve the picture quality or the stability of the processing solutions.

The silver halide photographic material of the present invention can also be used as heat developable photographic materials disclosed, for example, in U.S. Pat. No. 4,500,626, JP-A-60-133449, JP-A-59-218443, JP-A-61-238056 and European Patent 210,660A2.

The present invention is now illustrated in greater detail by reference to the following examples which, however, are not to be construed as limiting the invention in any way. Unless otherwise indicated herein, all parts, percents, ratios and the like are by weight.

Dyes D-1 to D-5 used in the following examples had the following structural formulas.

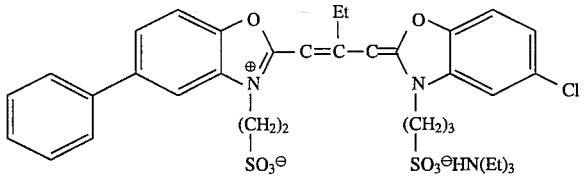

D-1

5-Chloro-5'-phenyl-9-ethyl-3-(3-sulfopropyl)-3'-(2-sulfoethyl)-oxacyanine triethylammonium -continued

D-2

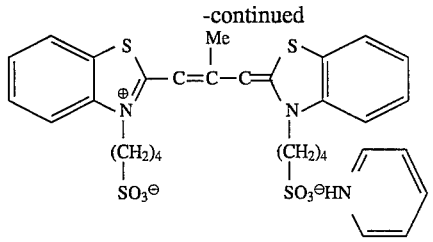

9-Methyl-3,3'-di(sulfobutyl)-thiacarbocyanine pyridinium

D-3

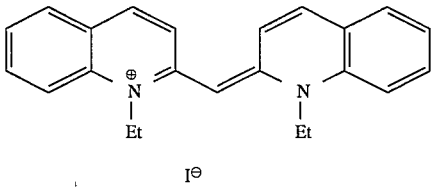

1,1'-Diethyl-2,2'-cyanine iodide

D-4

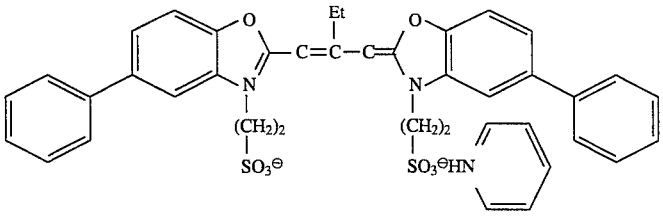

5.5'-Diphenyl-9-ethyl-3,3'-di-(2-sulfoethyl)oxacyanine pyridinium

D-5

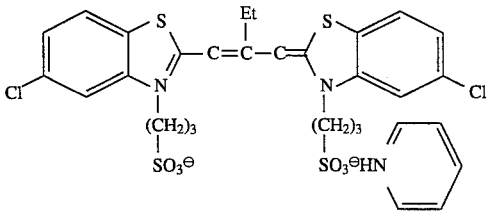

5,5'-Dichloro-9-ethyl-3,3'-di-(3-sulfopropyl)thiacarbocyanine pyridinium.

EXAMPLE 1

To an aqueous solution formed by adding 3% of gelatin and 2% of ammonia and kept at 50° C., were simultaneously added an aqueous solution of silver nitrate and an aqueous solution of potassium bromide over a period of 60 minutes. While stirring the reaction mixture (solution) well, the silver potential was kept constant was carried out to prepare an emulsion comprising octahedral silver bromide grains having a mean grain size of 0.8 μm. Further, an emulsion comprising cubic silver bromide grains having a mean grain size of 0.8 μm was prepared in the same manner as described above except that the silver potential was kept at +60 mV.

To 25 g of the thus-prepared octahedral or cubic emulsion was added 2 ml of a methanol solution of the dye (concentration: 1/1000 mol/l) as shown below, and the mixture was stirred at 60° C. for 60 minutes to thereby allow the dye to be adsorbed. The temperature of the emulsion was then lowered to 40° C. A predetermined amount of various solid adsorbents was then added thereto. The mixture was stirred at 40° C. for 17 hours and filtered through the EGG filter having a pore size of 10 μm to separate the solid adsorbent and the emulsion from each other. The types of the solid adsorbents and the form thereof used are shown in Table 1 below. The solid adsorbents HP-40 and CHP-20P are porous organic synthetic resins without an ion exchange group in accordance with the present invention, whereas the other solid adsorbents are not. The amount of the dye desorbed by the treatment with the solid adsorbent was determined in the following manner. The change in reflectance caused by the dye in the emulsion was measured using a Hitachi 307 type color analyzer, and the amount of the dye desorbed was calculated using the Kubelka-Munk formula. The results are shown in Table 2 below.

TABLE 1

| Solid Adsorbent | Type (structure) | Treatment | Average Particle Size (μm) | Manufacturer |
|---|---|---|---|---|
| Activated carbon | — | — | 10 | Wako Junyaku KK |
| PAD | Strongly basic anion exchange resin ($OH^-$ type) | Neutralized with 1N hydrochloric acid | 50 | Japan Organo Co., Ltd. |
| WK-20 | Weakly basic anion exchange resin | Crushed into particles of 10 μm in a mortar | 10 | Mitsubishi Kasei Corp. |
| PCH | Strongly acidic cation exchange resin | Neutralized with an aqueous solution of 1N sodium hydroxide | 50 | Japan Organo Co., Ltd. |
| WA-10 | Weakly acidic cation exchange resin | Crushed into particles of 10 μm in a mortar | 10 | Mitsubishi Kasei Corp. |
| HP-40 | Porous crosslinked polystyrene resin | Crushed into particles of 10 μm in a mortar | 10 | Mitsubishi Kasei Corp. |
| CHP-20P | Porous crosslinked Polystyrene resin | Crushed inot particles of 10 μm in a mortar | 55 | Mitsubishi Kasei Corp. |
| Zeolite | Synthetic zeolite A-4 (Na type) | — | 70 | Wako Junyaku KK |

TABLE 2

Desorption of Dye with Solid Adsorbent

| Dye | Solid Adsorbent | Amount Added (g) | Amount of Dye Desorbed (%) |
|---|---|---|---|
| D-1 | Activated carbon | 1 | 93 |
| | PAO | 6 | 98 |
| | WA-20 | 3 | 95 |
| | HP-40 | 3 | 93 |
| | CHP-20P | 10 | 100 |
| D-2 | Activated carbon | 1 | 91 |
| | PAO | 6 | 98 |
| | WA-20 | 3 | 92 |
| | HP-40 | 3 | 94 |
| | CHP-20P | 10 | 100 |
| D-3 | Activated carbon | 1 | 98 |
| | PCH | 6 | 99 |
| | WK-20 | 3 | 98 |
| | Zeolite | 5 | 99 |
| | HP-40 | 3 | 99 |
| | CHP-20P | 10 | 100 |
| D-4 | Activated carbon | 1 | 92 |
| | PAO | 6 | 93 |
| | WA-20 | 3 | 95 |
| | HP-40 | 3 | 99 |
| | CHP-20P | 10 | 100 |
| D-5 | Activated carbon | 1 | 93 |
| | PAO | 6 | 90 |
| | WA-20 | 3 | 95 |
| | HP-40 | 3 | 94 |
| | CHP-20P | 10 | 98 |

(PAO is a powdex (powder resin) anion exchange resin and WA-20 is an anion exchange resin of Mitsubishi Kasei Corp.).

As shown in Table 2 above, at least 90% of the amounts of the dyes was well-desorbed using the porous organic synthetic resins without any ion exchange group according to the present invention. Particularly, the desorption efficiency of the adsorbent CHP was higher than that of the other adsorbents.

EXAMPLE 2

To an aqueous solution formed by adding 3% of gelatin and 2% of ammonia and kept at 50° C., were simultaneously added a 17 wt % aqueous solution of silver nitrate, a 12 wt % aqueous solution of potassium bromide and a methanol solution of Dye D-2 (concentration: 1/500 mol/l) (added at a flow rate of 1/7 of that of silver nitrate) over a period of 40 minutes. While stirring the reaction mixture (solution) well, silver potential was kept constant at 50 mV. After completion of the reaction, desalting was carried out to obtain an emulsion comprising cubic silver bromide grains having a mean grain size of 0.8 μm. For the purpose of comparison, an emulsion comprising cubic silver bromide grains having a mean grain size of 0.8 μm was prepared in the same manner as described above except that methanol was added in place of the dye solution. A predetermined amount of each of the solid adsorbents of the present invention was added to 50 g of the emulsion comprising the grains formed in the presence of the dye, and the mixture was stirred at 55° C. for one hour to thereby determine the desorption of the dye. The amount of the dye desorbed was calculated from the change in reflectance caused by the dye in the emulsion in the same manner as in Example 1. The results obtained are shown in Table 3 below.

TABLE 3

Desorption of Dye Added During Formation of Grains

| Solid Adsorbent | Amount Added (g) | Amount of Dye Desorbed (%) |
|---|---|---|
| HP-40 | 3 | 95 |
| CHP-20P | 6 | 100 |
| PAO | 6 | 99 |
| WA-20 | 6 | 95 |

Note:
Treatment before addition of solid adsorbent to emulsion was made according to that of Table 1.

As shown in Table 3, at least 90% of the dye added was desorbed well by using the porous organic synthetic resin without any ion exchange group according to the present invention. Particularly, the desorption efficiency of the adsorbent CHP was higher than that of other adsorbents.

A hardening agent for gelatin and a coating aid were added to 40 g of each of an emulsion obtained by forming grains in the presence of the above described dye and an emulsion obtained by subjecting the emulsion prepared above to a dye desorption treatment with MCI Gel CHP-20P (manufactured by Mitsubishi Kasei Corp.) and then filtering the emulsion immediately through a microfilter to remove the adsorbent. Each of the resulting emulsions and a gelatin protective layer were simultaneously coated on a cellulose acetate film to obtain a film.

The films were exposed to light from a tungsten lamp (color temperature; 2854 K.) through a continuous wedge and a color filter for one second. A combination of a V40 filter and a UVD33S filter as a blue exposure which excited silver halide was used as the color filter, and the samples were irradiated with light with a wavelength in the range of 330 to 400 nm. Further, the samples were irradiated by exposure through a Fuji gelatin filter SC-52 (manufactured by Fuji Photo Film Co., Ltd.) to screen light with a wavelength of 520 nm or below as a minus blue exposure which excited the dye. The exposed samples were developed with the following surface developing solution MAA-1 at 20° C. for 10 minutes.

| Surface Developing Solution MAA-1 | |
|---|---|
| Metol (N-methyl-p-aminophenol sulfate) | 2.5 g |
| L-Ascorbic Acid | 10 g |
| Nabox (sodium tetraborate pentahydrate) (a product of Fuji Photo Film Co., Ltd.) | 35 g |
| Potassium Bromide | 1 g |
| Add water to make | 1 liter |
| pH | 9.8 |

The optical density of each of the developed films was measured using a Fuji autographic densitometer (produced by Fuji Photo Film Co., Ltd.). The reciprocal of the exposure amount providing an optical density of (fog+0.2) is referred to herein as the sensitivity. The sensitivity is represented in terms of the relative sensitivity.

The sensitivity of the film coated with the emulsion from which the dye was desorbed with the solid adsorbent was 3.2 times higher than that of the emulsion which was not subjected to the solid adsorbent treatment, and fogging due to residual color of the treated emulsion hardly occurred in comparison with the untreated emulsion as shown in Table 4 below.

TABLE 4

| Chance in Sensitivity and Residual Color with Desorption of Dye | | |
|---|---|---|
| | Sensitivity(1) | Residual Color (2) |
| Before Desorption of Dye | 100 | 0.48 |
| After desorption of Dye | 321 | 0.12 |

(1)Relative sensitivity when the sensitivity before desoprtion of the dye is referred to as 100.
(2)Density of unexposed area

EXAMPLE 3

Each of octahedral and cubic emulsions prepared in the same manner as in Example 1 was divided into portions. A methanol solution of 1 g of the dye per mol of silver halide was added to each portion at 60° C. After 15 minutes, 2.7 mg of sodium thiosulfate was added thereto, and sensitization was further carried out at 60° C. for 45 minutes to thereby obtain an after-ripened emulsion (designated Emulsion A).

A 40-gram portion of the after-ripened emulsion was added to a dispersion of 10 g of the adsorbent (MCI Gel CHP-20P, manufactured by Mitsubishi Kasei Corp.) used in the present invention in 10 ml of the mixture of water and methanol (1:1 (by volume)). The mixture was stirred at 40° C. for 2 hours and immediately filtered through a microfilter to remove the adsorbent (designated Emulsion B). 100% of the dye added was desorbed by this adsorbent treatment.

40 g of the emulsion after the above dye desorption treatment was kept at a temperature of 40° C., and 4 ml of a cyanine dye at a concentration of $4\times10^{-3}$ mol/l was added thereto. The mixture was stirred for 20 minutes (designated Emulsion C). The amount of the dye adsorbed was determined in the following manner. The reflectance of the peak of the characteristic absorption wavelength specific to each added dye on silver-halide was measured, and the amount of the dye adsorbed was calculated from the Kubelka-Munk formula in the same manner as in Example 1. The results obtained are shown in Table 5 below. For the purpose of comparison, the dye was added to the emulsion which was not subjected to the dye desorption treatment. The results are also shown in Table 5 below.

TABLE 5

| Crystalline Phase | Dye Added Before After-Ripening | Treatment with Adsorbent | Dye Added After Completion of After-Ripening | Adsorption Ratio of Dye Added After Completion of After-Ripening | |
|---|---|---|---|---|---|
| Cube | D-1 | not made | D-2 | 2% | Comp. Ex. |
| | " | not made | D-5 | 1% | Comp. Ex. |
| | " | made | D-2 | 99% or above | Invention |

TABLE 5-continued

| Crystalline Phase | Dye Added Before After-Ripening | Treatment with Adsorbent | Dye Added After Completion of After-Ripening | Adsorption Ratio of Dye Added After Completion of After-Ripening | |
|---|---|---|---|---|---|
| | " | made | D-5 | 99% or above | Invention |
| | D-2 | not made | D-1 | 1% | Comp. Ex. |
| | " | not made | D-5 | 1% | Comp. Ex. |
| | " | made | D-1 | 99% or above | Invention |
| | " | made | D-5 | 99% or above | Invention |
| Octahedron | D-1 | not made | D-2 | 1% | Comp. Ex. |
| | " | not made | D-5 | 1% | Comp. Ex. |
| | " | made | D-2 | 99% or above | Invention |
| | " | made | D-5 | 99% or above | Invention |
| | D-2 | not made | D-1 | 1% | Comp. Ex. |
| | " | not made | D-5 | 1% | Comp. Ex. |
| | " | made | D-1 | 99% or above | Invention |
| | " | made | D-5 | 99% or above | Invention |

As shown by the results in Table 5, the dyes are well-desorbed by the treatment with the solid adsorbent, and it becomes possible for the dye to be again adsorbed by silver halide. On the other hand, the dye is not adsorbed by silver halide even when the dye is further added to the emulsion which had not been subjected to the treatment with the solid adsorbent.

A hardening agent for gelatin and a coating aid were added to 40 g of a cubic emulsion which was treated in the same manner as shown by Emulsions A, B and C. The resulting emulsions and a gelatin protective layer were simultaneously coated on a cellulose acetate film to obtain a film. For the purpose of comparison, the cubic emulsion was after-ripened under the same conditions as those for Emulsion A except that the dye was added, and the emulsion as after-ripened was coated to obtain a film (Sample 1 of Table 6). After conducting after-ripening, 4 ml of a cyanine dye (concentration $4\times10^{-3}$ mol/l) was added, and the emulsion as such was coated to obtain a film (Sample 3 of Table 6). The relative blue sensitivity and minus blue sensitivity of the thus-obtained films were measured in the same manner as in Example 2. The results obtained are shown in Table 6 below. Exposure and development were carried out in the same manner as in Example 2.

TABLE 6

| | Dye Added Before After-Ripening | Treatment with Adsorbent | Dye Added After Completion of After-Ripening | Relative Blue Sensitivity | Relative Mines Blue Sensitivity |
|---|---|---|---|---|---|
| Comp. Ex. Sample 1 | omitted | not made | omitted | 100 (standard) | ~0 |
| Comp. Ex. Sample 2 | omitted | made | omitted | 100 | ~0 |
| Comp. Ex. Sample 3 | omitted | not made | D-1 | 79.4 | 100 (standard) |
| Comp. Ex. Sample 4 | D-1 | not made | omitted | 141 | 250 |
| Invention Sample 5 | D-1 | made | omitted | 354 | ~0 |
| Invention Sample 6 | D-1 | made | D-1 | 141 | 250 |
| Invention Sample 7 | D-1 | made | D-2 | 270 | 700 |
| Comp. Ex. Sample 8 | D-2 | not made | omitted | 250 | 630 |

As shown by the results in Table 6, the minus blue sensitivity of Sample 4 after-ripened after the addition of the dye is higher than that of Sample 3 which was after-ripened before the addition of the dye an to which the Dye D-1 was then added, and Sample 4 has improved chemical sensitization. However, since the adsorbed dye interferes with the adsorption of the other dye as described above, spectral sensitization can not be carried out using other dyes. When the treatment with the adsorbent of the present invention is carried out, Dye D-1 is desorbed as shown in Example 1, and the blue sensitivity of Sample 5 obtained by coating the resulting emulsion is surprisingly higher than that of Sample 1 after-ripened in the absence of the dye.

The emulsion treated with the adsorbents of the present invention can be spectral-sensitized by adding any dye, and Sample 7 can be spectral-sensitized by Dye D-2 as shown in Table 6, and Sample 7 is surprisingly improved in minus blue sensitivity in comparison with Sample 8 chemically sensitized by adding Dye D-2 before after-ripening.

Namely, even when the dyes are used as a chemical sensitization aid, the chemical sensitization performance is improved by the present invention, and silver halide photographic materials having good dye adsorptivity can be obtained.

EXAMPLE 4

1000 ml of an aqueous solution containing 10.5 g of gelatin and 3.0 g of KBr was kept at a temperature of 60° C. and stirred. An aqueous solution of silver nitrate ($AgNO_3$: 8.2 g) and an aqueous halide solution (KBr: 5.7 g, KI: 0.35 g) were added thereto over a period of one minute using the double jet process. After 21.5 g of gelatin was added thereto, the temperature was elevated to 75° C. An aqueous solution of silver nitrate ($AgNO_3$: 136.3 g) and an aqueous halide solution (containing 4.2 mol % of KI based on the amount of KBr) were added thereto at an accelerating flow rate over a period of 51 minutes using a double jet process, while the silver potential was kept at 0 mV against a saturated calomel electrode. The temperature was reduced to 40° C., and an aqueous solution of silver nitrate ($AgNO_3$: 28.6 g) and an aqueous solution of KBr were added thereto over a period of 5.35 minutes using a double jet process, while the silver potential was kept at −50 mV against a saturated calomel electrode. The resulting emulsion was desalted by flocculation method. After gelatin was added thereto, the pH was adjusted to 5.5 and the pAg was adjusted to 8.8. The resulting emulsion comprised tabular grains having a grain size of 1.14 μm (in terms of an average diameter of the corresponding circle), an average thickness of 0.189 μm, an average aspect ratio of 6.03 and a coefficient of variation in grain size (in terms of an average diameter of the corresponding circle) of 28%.

To the resulting emulsion was added a sensitizing dye (0.4 g/mol of Ag) at 60° C. After 20 minutes, sodium thiosulfate (2.7 mg/mol of Ag), chloroauric acid (4.1 mg/mol of Ag) and potassium thiocyanate (77 mg/mol of Ag) were added thereto, and further chemical ripening was carried out for 40 minutes.

To 40 g of the chemically sensitized emulsion was added activated carbon or CHP-20P to desorb the dye in the same manner as in Example 3. The results are shown in Table 7 below.

TABLE 7

Desorption of Dye from Tabular Grains

| Dye Added Before After-Ripening | Type of Adsorbent | Amount (g) | Desorption Ratio of Dye (%) |
|---|---|---|---|
| D-1 | Activated carbon | 3 | 98 |
| " | CHP-20P | 10 | 100 |
| D-2 | Activated carbon | 3 | 99 |
| " | CHP-20P | 10 | 100 |
| D-3 | Activated carbon | 3 | 95 |
| " | CHP-20P | 10 | 100 |
| D-4 | Activated carbon | 3 | 93 |
| " | CHP-20P | 10 | 100 |

As shown by the results in Table 7, it can be seen that almost all of the dye added can be seen desorbed by the treatment with the adsorption carriers used in the present invention.

The following compounds were added to each of the above after-ripened emulsions and the emulsion from which the dye was desorbed using CHP-20 in the same manner as in Example 3. Each of the emulsions and a protective layer were coated on a triacetylcellulose film support having a subbing layer using a co-extrusion method.

(1) Emulsion Layer

| (1) Emulsion Layer | |
|---|---|
| Emulsion | Emulsion comprising the above tabular grains |
| Coupler | 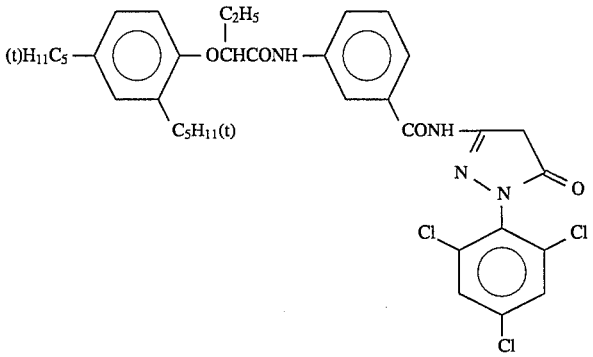 |
| Tricresyl Phosphate | |
| Stabilizer | 4-hydroxy-6-methyl-1,3,3a,7-tetrazaindene |
| Coating Aid | Sodium dodecylbenzenesulfonate |

(2) Protective Layer

Fine particles of polymethyl methacrylate

Sodium salt of 2,4-dichloro-6-hydroxy-s-triazine

Gelatin

In the emulsion layer (1) above, the coated amount of the emulsion is about 20 mmol/$m^2$ as Ag, that of the coupler is about 12 mol/mol of Ag, that of the stabilizer is about 2.1 mmol/mol of Ag and that of gelatin is about 1 μm/$m^2$.

These samples were subjected to exposure (1/100 sec) for sensitometry, and then the following color development was carried out.

The development was carried out at 38° C. under the following conditions.

| | |
|---|---|
| 1 Color development | 2 min 45 sec |
| 2 Bleaching | 6 min 30 sec |
| 3 Rinse | 3 min 15 sec |
| 4 Fixing | 6 min 30 sec |
| 5 Rinse | 3 min 15 sec |
| 6 Stabilization | 3 min 15 sec |

The processing solutions used in each stage had the following compositions.

| Color Development | |
|---|---|
| Sodium Nitrilotriacetate | 1.0 g |
| Sodium Sulfite | 4.0 g |
| Sodium Carbonate | 30.0 g |
| Potassium Bromide | 1.4 g |

-continued

| | |
|---|---|
| Hydroxylamine Sulfate | 2.4 g |
| 4-(N-Ethyl-N-8-hydroxyethyl-amino)-2-methylaniline Sulfate | 4.5 g |
| Water to make | 1 liter |
| Bleaching Solution | |
| Ammonium Bromide | 160.0 g |
| Ammonia Water (28%) | 25.0 ml |
| Sodium Ethylenediaminetetraacetate | 130 g |
| Glacial Acetic Acid | 14 ml |
| Water to make | 1 liter |
| Fixing Solution | |
| Sodium Tetrapolyphosphate | 2.0 g |
| Sodium Sulfite | 4.0 g |
| Ammoniam thiosulfate (70 wt/vol % aq. soln.) | 175.0 ml |
| Sodium Bisulfite | 4.6 g |
| Water to make | 1 liter |
| Stabilizing Solution | |
| Formalin | 8.0 ml |
| Water to make | 1 liter |

The density of each of the processed samples was measured using a green filter. The reciprocal of the exposure amount providing a density of (fog+0.2) is referred to as the sensitivity. The sensitivity of each sample is represented as the relative sensitivity when the sensitivity of Sample 1 is referred to as 100. The results of fog and sensitivity are shown in Table 8 below.

TABLE 8

Change in Sensitivity and Residual Color with Desorption Ratio of Dye

| Dye Added Before After-Ripening | Sensitivity[1)] | Residual Color[2)] | |
|---|---|---|---|
| D-1 before desorption | 100 | 0.41 | Com. Ex. |
| D-1 after desorption | 151 | 0.15 | Invention |
| D-2 before desorption | 100 | 0.38 | Com. Ex. |
| D-2 after desorption | 200 | 0.12 | Invention |
| D-3 before desorption | 100 | 0.38 | Com. Ex. |
| D-3 after desorption | 121 | 0.12 | Invention |
| D-4 before desorption | 100 | 0.45 | Com. Ex. |
| D-4 after desorption | 130 | 0.13 | Invention |

Note
[1)]Relative sensitivity when sensitivity before desorption of each dye is referred to as 100.
[2)]Density of unexposed area It can be seen from the results in Table 8 that when the treatment with the solid adsorbent is carried out, emulsions having high blue sensitivity and no residual color can be obtained.

EXAMPLE 5

To a gelatin solution containing potassium bromide kept at 65° C., was added an aqueous ammonia in an amount so as to contain 0.3 wt/vol % of ammonia. An aqueous solution of silver nitrate and an aqueous solution containing a 3:97 (by mol) mixture of potassium iodide and potassium bromide were added thereto with stirring using a controlled double jet process while keeping the pAg at 7.9. The addition was continued until the amount of silver nitrate used reached 5% of the total amount thereof to be used.

Subsequently, an aqueous solution of silver nitrate and an aqueous solution containing a 24:76 mixture of potassium iodide and potassium bromide were added thereto with stirring using a controlled double jet process while keeping the pAg at 7.7. The addition was continued until the amount of silver nitrate used reached 49% of the total amount thereof to be used.

Subsequently, an aqueous solution of silver nitrate and an aqueous solution of potassium bromide were added thereto with stirring using a controlled double jet process while keeping the pAg at 8.2. The addition was continued until the amount of silver nitrate used reached 46% of the total amount thereof to be used.

After desalting was carried out, 60 g of gelatin per mol of silver was added thereto, the pH was adjusted to 6.8 and the pAg was adjusted to 8.4 at 40° C. The resulting emulsion was referred to as Emulsion B. Emulsion B comprised triple structural normal crystalline octahedral grains having a mean grain size of 0.90 μm, composed of, in order from the center of the triple structure, 5% of a silver bromide layer containing 5 mol of silver iodide, 49% of a silver iodobromide layer containing 24 mol of silver iodide and 46% of a pure silver bromide layer.

To the resulting emulsion was added a sensitizing dye (0.4 g/mol of Ag) at 60° C. After 20 minutes, sodium thiosulfate (2.7 g/mol of silver), chloroauric acid (4.1 mg of mol of silver) and potassium thiocyanate (77 mg/mol of silver) were added thereto, and chemical ripening was carried out further for 40 minutes.

40 g of the above chemically ripened emulsion was subjected to a dye desorption treatment in the same manner as in Example 3. The results obtained are shown in Table 9 below.

TABLE 9

Desorption of Dye from Triple Structural Grains

| Dye Added Before After-Ripening | Type of Adsorbent | Amount (g) | Desorption Ratio of Dye (%) |
|---|---|---|---|
| D-1 | Activated carbon | 3 | 95 |
| " | CHP-20P | 10 | 100 |
| D-2 | Activated carbon | 3 | 98 |
| " | CHP-20P | 10 | 100 |
| D-3 | Activated carbon | 3 | 98 |
| " | CHP-20P | 10 | 100 |
| D-4 | Activated carbon | 3 | 92 |
| " | CHP-20P | 10 | 100 |

As shown by the results in Table 9, it can be seen that when the treatment with the adsorption carrier used in the present invention is carried out, almost all of the dye added can be desorbed.

EXAMPLE 6

An aqueous solution of silver nitrate and an aqueous solution of potassium bromide were simultaneously added to an aqueous gelatin solution containing potassium bromide kept at 35° C. with vigorously stirring. The temperature of the mixture was increased to 75° C., and an aqueous solution of silver nitrate and an aqueous solution of potassium bromide were added thereto to form a core portion.

Subsequently, an aqueous solution of silver nitrate, an aqueous solution of potassium bromide and an aqueous solution of potassium iodide were simultaneously added thereto, and further an aqueous solution of silver nitrate and an aqueous solution of potassium bromide were simultaneously added thereto to form a shell. After water washing and desalting were carried out by the flocculation method, gelatin was added thereto, the pH was adjusted to 6.5 and the pAg was adjusted to 8.6.

The resulting silver iodobromide emulsion comprised triple structural tabular grains wherein the central core was composed of silver bromide, the inner circular portion was composed of 9.9 mol % of silver iodide, and the outer circular portion was composed of silver bromide. The grains had an average iodide content of 6.0 mol %, a grain size of about 1.05 μm in terms of a diameter of a corresponding circle and a grain thickness of 0.25 μm. The emulsion was referred to as Emulsion (A).

A sensitizing dye, sodium salt of 5,5'-dichloro-3,3'-di(n-sulfopropyl)-9-ethyl-thiacarbocyanine (0.4 g/mol of silver), was added to the emulsion, and the emulsion was ripened at 60° C. for 60 minutes to prepare Emulsion (B).

The resulting emulsions were subjected to the following processing.

(1) Emulsion (B) was processed in such a manner that 50 g of a porous resin (MCI Gel CH-20P manufactured by Mitsubishi Kasei Corp.) was added to 200 g of Emulsion (B), and the mixture was stirred at 40° C. for 180 minutes and filtered through a microfilter (Sample 1).

(2) Emulsion (B) was processed in such a manner that 10 g of 2,7-dihydroxy-naphthalene was added to 200 g of Emulsion (B) and the mixture was stirred at 40° C. for 180 minutes (Sample 2).

(3) Emulsion (B) was processed in such a manner that 10 g of 2,7-dihydroxynaphthalene and then 50 g of a porous resin (the same as that used in (1) above) were added to 200 g of the emulsion and the mixture was stirred at 40° C. for 180 minutes and filtered through a microfilter (Sample 3).

To determine how to change the adsorption of the dye by the above treatments (1) to (3), the percent absorption of the emulsion at 655 nm was measured using spectrophotometer with an integrating sphere. The relative value of the change in percent absorption is shown in Table 10 below when the percent absorption of Emulsion (B) at 655 nm before the treatments of (1) to (3) above is referred to as 100 and the percent absorption of Emulsion (A) is referred to as 0.655 nm corresponds to the peak of the absorption of the J-associates of the dye on silver halide.

TABLE 10

| Sample | Relative Percent Absorption at 655 nm | |
|---|---|---|
| Emulsion A | 0 | Comp. Ex. |
| B | 100 | " |
| Sample 1 | 95 | " |
| 2 | 90 | " |
| 3 | 0 | Invention |

It is apparent from the results in Table 10 above that it is impossible for all of the dye on the silver halide to be removed by treatment (1) or (2), while all of the dye was removed by treatment (3) according to the present invention.

EXAMPLE 7

Emulsion (A) prepared in Example 6 was divided into 3 portions. 1.8 mg of sodium thiosulfate, 2.6 mg of chloroauric acid and 73 mg of potassium thiocyanate in order were added to a portion, each amount being per mol of silver halide. The emulsion was ripened at 62° C. for 60 minutes to obtain Emulsion (C). The sensitizing dye, sodium salt of 5,5'-dichloro-3,3'-di(4-sulfo-butyl)-8-ethyl-thiacyanine (0.4 g/mol of silver) as a chemical sensitization controlling agent was added to a portion. After 20 minutes, 1.8 mg of sodium thiosulfate, 2.6 mg of chloroauric acid and 73 mg of potassium thiocyanate in order were added thereto, and the emulsion was ripened at 62° C. for 60 minutes to obtain Emulsion (D). The sensitizing dye, sodium salt of 5,5'-dichloro-3,3'-di(n-sulfopropyl)-9-ethyl-thiacyanine (0.4 g/mol of silver), as a chemical sensitization controlling agent was added to a portion, and the same treatment for Emulsion (D) was carried out to obtain Emulsion (E).

To 200 g of each of the resulting three kinds of emulsions were added 50 g of a porous resin and 10 g of 2,7-dihydroxy-naphthalene in order. The mixture was stirred at 40° C. for 180 minutes and filtered through a microfilter. The thus-treated emulsions were referred to as Emulsions (C'), (D') and (E'), respectively.

A coupler, a hardening agent for gelatin and a coating aid were added to each of Emulsions (C), (D), (E), (C'), (D') and (E'). Each emulsion and a gelatin protective layer were simultaneously coated on a cellulose acetate film support.

The resulting samples were exposed through a wedge and an interference filter of 391 nm for 1/100 sec and the following color development was carried out.

| Emulsion Coating Conditions | |
|---|---|
| (1) Emulsion Layer | |
| Emulsion | Each emulsion ($7.9 \times 10^{-3}$ mol/m$^2$ in terms of silver) |
| Coupler | ($1.5 \times 10^{-3}$ mol/m$^2$) |

-continued

Emulsion Coating Conditions

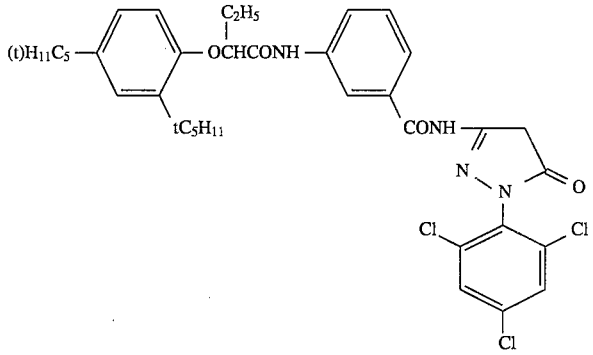

| | |
|---|---|
| Tricresyl Phosphate | (1.10 g/m$^2$) |
| Gelatin | (2.30 g/m$^2$) |
| (2) Protective Layer | |
| Sodium Salt of 2,4-Dichloro-6-hydroxy-s-triazine | (0.08 g/m$^2$) |
| Gelatin | (1.80 g/m$^2$) |

These samples were allowed to stand 40° C. and 70% RH for 14 hours.

The resulting samples were exposed through a wedge and an interference filter of 391 nm for 1/100 sec and then the following color development was carried out.

| | |
|---|---|
| 1. Color development | 2 min 45 sec |
| 2. Bleaching | 6 min 30 sec |
| 3. Rinse | 3 min 15 sec |
| 4. Fixing | 6 min 30 sec |
| 5. Rinse | 3 min 15 sec |
| 6. Stabilization | 3 min 15 sec |

The processing solutions used in each stage had the following composition

| | |
|---|---|
| Color Developing Solution | |
| Sodium Nitrilotriacetate | 1.0 g |
| Sodium Sulfite | 4.0 g |
| Sodium Carbonate | 30.0 g |
| Potassium Bromide | 1.4 g |
| hydroxylamine Sulfate | 2.4 g |
| 4-(N-Ethyl-N-β-hydroxyethyl-anino)-2-methylaniline Sulfate | 4.5 g |
| Water to make | 1 liter |
| Bleaching Solution | |
| Ammonium Bromide | 160.0 g |
| Ammonia Water (28%) | 25.0 g |
| Sodium Ethylenediaminetetra-acetato Ferrate | 130.0 g |
| Glacial Acetic Acid | 14 ml |
| Water to make | 1 liter |
| Fixing Solution | |
| Sodium Tetrapolyphosphate | 2.0 g |
| Sodium Sulfite | 4.0 g |
| Ammonium Thiosulfate (70 wt/vol % aq. soln.) | 175.0 ml |
| Sodium Bisulfite | 4.6 g |
| Water to make | 1 liter |
| Stabilizing Solution | |
| Formalin | 8.0 g |

-continued

| | |
|---|---|
| Water to make | 1 liter |

The density of the processed samples was measured with a green filter.

The reciprocal of the exposure amount providing an optical density of (fog+0.5) is referred to as the sensitivity. The sensitivity is shown in Table 11 below as a relative sensitivity when the sensitivity of Emulsion (C) is referred to as 100.

It is apparent from Table 11 that the emulsions which are chemically sensitized in the presence of the adsorptive compound and then treated with an porous resin in the presence of the desorption accelerator, have higher photographic sensitivity that of comparative examples.

Further, each of the sensitizing dyes was added before coating, and a comparison of sensitivity in the spectral sensitization region was made. Nearly the same results as those shown in Table 11 were obtained.

TABLE 11

| Sample | Relative Percent Absorption at 391 nm | |
|---|---|---|
| Emulsion (C) | 100 | Comp. Ex. |
| (D) | 105 | " |
| (E) | 11 | " |
| (C') | 95 | " |
| (D') | 115 | Invention |
| (E') | 126 | |

EXAMPLE 8

To an aqueous gelatin solution containing potassium bromide (gelatin: 40 g, pBr: 2.8, pH: 6.0, water: 955 ml) kept at 75° C. with vigorously stirring, were simultaneously added an aqueous solution of silver nitrate and an aqueous solution of potassium bromide while keeping the pBr at 2.8. Subsequently, 3 g of potassium bromide was added thereto, and an aqueous solution of silver nitrate and an aqueous solution of potassium bromide were added thereto using a controlled double jet process to prepare octahedral silver bromide emulsion grains having a grain size of 0.8 μm in terms of a diameter of a corresponding sphere. After water washing and desalting were carried out by a conventional flocculation method, gelatin was added thereto, the pH was adjusted to 6.4 and the pAg was adjusted to 8.6. The resulting emulsion was referred to as Emulsion (F).

To an aqueous gelatin solution containing potassium bromide kept at 30° C. with vigorously stirring, were added an aqueous solution of silver nitrate and an aqueous solution of potassium bromide. The temperature of the mixture was increased to 75° C. Silver nitrate and ammonia water were added thereto to adjust the pBr and the pH. After physical ripening was carried out, acetic acid was added, and an aqueous solution of silver nitrate and an aqueous solution of potassium bromide were added. Subsequently, an aqueous solution of silver nitrate, an aqueous solution of potassium bromide and an aqueous solution of potassium iodide were added at an accelerating flow rate. The temperature of the mixture was then decreased to 40° C. An aqueous solution of silver nitrate and an aqueous solution of silver iodide were simultaneously added thereto, and further an aqueous solution of silver nitrate and an aqueous solution of silver bromide were added thereto. Water washing and desalting were carried out by the conventional flocculation method to obtain a tabular silver iodobromide emulsion having an average aspect ratio of 5.3, a means grain size of 1.25 μm in terms of the average diameter of corresponding spheres, a grain thickness of 0.25 μm, an average iodide content of 9.5 mol % and a dislocation on the periphery of a grain area. The emulsion was referred to as Emulsion (G).

An aqueous solution of silver nitrate, an aqueous solution of potassium bromide and ammonia water were added to an aqueous gelatin solution containing potassium bromide, potassium iodide and ammonium nitrate kept at 35° C. with vigorously stirring. The temperature of the mixture was elevated to 76° C., and an aqueous solution of silver nitrate and an aqueous solution containing potassium bromide and potassium iodide together with ammonium nitrate were added thereto. After water washing and desalting were carried out by a conventional flocculation method, gelatin was added thereto, the pH was adjusted to 6.2 and the pAg was adjusted to 8.4. The resulting silver iodobromide emulsion was an emulsion comprising twin grains having a mean grain size of 0.70 μm in terms of the mean value of the diameters of spheres and an average iodide content of 10.2 mol %. The emulsion was referred to as Emulsion (H).

The sodium salt of 5,5'-dichloro-3,3'-di(n-sulfobutyl)thiacyanine (Dye a) or the sodium salt of 5,5'-dichloro-3,3'-di(n-sulfopropyl)-9-ethylthiacarbocyanine (Dye b) was added to each of Emulsions (F), (G) and (H) and Emulsion (A) prepared in Example 6 as indicated in Table 12 below, with each dye being used in an amount of 0.055 mmol per mol of silver. The emulsions were ripened at 60° C. for 60 minutes to obtain Samples 1 to 6.

These samples were processed in the following manner.

(1) To 200 g of each sample was added 50 g of an adsorption carrier (MCI Gel CHP-20 manufactured by Mitsubishi Kasei Corp., particle size: 75 to 150 μm), and the mixture was stirred at 40° C. for 180 minutes and filtered through a microfilter to remove the porous resin.

(2) To 200 g of each of the samples were added a desorption accelerator as shown in Table 13 below and 50 g of the porous resin (the same as that used in (1) above) in order, and the mixture was stirred at 40° C. for 60 minutes and filtered through a microfilter to remove the porous resin. Among the desorption accelerators shown in Table 13, Accelerators 10 to 20 were added as a methanol solution.

To examine the change in the adsorption of the Dyes a and b caused by these treatments, the absorption spectra of the emulsions were measured using a spectrophotometer with an integrating sphere. The absorption peak of the J-associate of each sample was observed. Changes in the percent absorption of the absorption peaks of J-associates of Samples 1 to 6 occurring due to treatments (1) and (2) above are shown in Table 14 below. The values of the percent absorption are represented as relative values when the percent absorption of the absorption peak of untreated J-associate is referred to as 100, and the percent absorption of the emulsion before the addition of the dye in the same wavelength region is referred to as 0.

TABLE 12

| Sample | Emulsion | Dye |
|---|---|---|
| 1 | (A) | (a) |
| 2 | (A) | (b) |
| 3 | (F) | (a) |
| 4 | (G) | (a) |
| 5 | (G) | (b) |
| 6 | (H) | (b) |

It can be understood that Dyes a or b can be completely removed by using the desorption accelerator in combination with a porous resin, although it is impossible for all of the dye to be completely removed only using the porous resin.

TABLE 13

| Desorption Accelerator in Example 8 | |
|---|---|
| 1 | Methanol |
| 2 | Phenol |
| 3 | 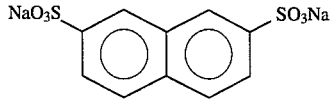 |
| 4 | 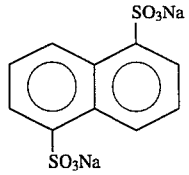 |
| 5 | 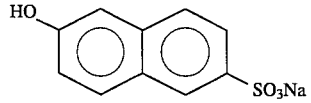 |
| 6 | 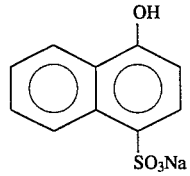 |
| 7 | 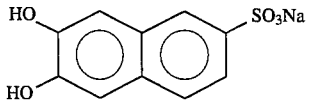 |

TABLE 13-continued

| Desorption Accelerator in Example 8 | |
|---|---|
| 8 | 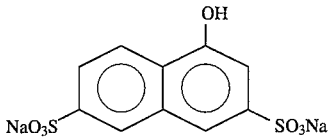 |
| 9 | 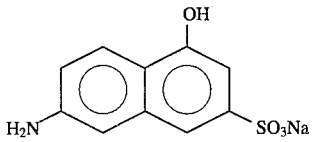 |
| 10 | 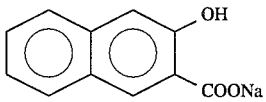 |
| 11 | 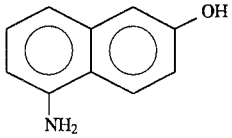 |
| 12 | 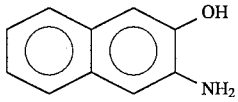 |
| 13 | 1-Naphthol |
| 14 | 2-Naphthol |
| 15 | 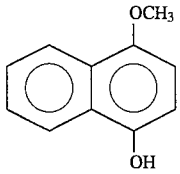 |
| 16 | 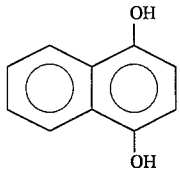 |

TABLE 13-continued

| Desorption Accelerator in Example 8 | |
|---|---|
| 17 | 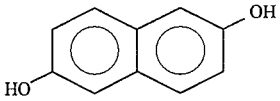 |
| 18 | 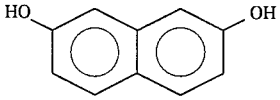 |
| 19 | 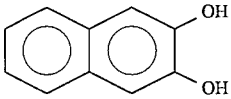 |
| 20 | 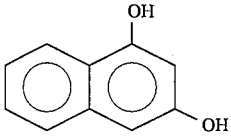 |

TABLE 14

| Desorption Accelerator | Emulsion Used | Amount of Desorption Accelerator Used per 200 g of Emulsion (g) | Relative Percent Absorption of J-band Peak After Treatment with Porous Resin (1) Treatment (Comp. Ex.) | (2) Treatment (invention) |
|---|---|---|---|---|
| 1 | Sample 3 | 80 | 63 | 0 |
| 2 | Sample 2 | 25 | 89 | 0 |
| 3 | Sample 3 | 10 | 63 | 0 |
| 4 | Sample 3 | " | " | 0 |
| 5 | Sample 3 | " | " | 0 |
| 6 | Sample 3 | " | " | 0 |
| 7 | Sample 3 | " | " | 0 |
| 8 | Sample 3 | " | " | 0 |
| 9 | Sample 3 | " | " | 0 |
| 10 | Sample 3 | " | " | 0 |
| 11 | Sample 3 | " | " | 0 |
| 12 | Sample 3 | " | " | 0 |
| 13 | Sample 1 | 5 | 82 | 0 |

TABLE 14-continued

| Desorption Accelerator | Emulsion Used | Amount of Desorption Accelerator Used per 200 g of Emulsion (g) | Relative Percent Absorption of J-band Peak After Treatment with Porous Resin (1) Treatment (Comp. Ex.) | (2) Treatment (invention) |
|---|---|---|---|---|
| 14 | Sample 1 | " | " | 0 |
| 15 | Sample 3 | 5 | 63 | 0 |
| 16 | Sample 4 | 10 | 95 | 0 |
| 17 | Sample 4 | " | 95 | 0 |
| 18 | Sample 6 | " | 100 | 0 |
| 19 | Sample 6 | " | 100 | 0 |
| 20 | Sample 5 | " | 99 | 0 |

EXAMPLE 9

To one liter of an aqueous solution containing 3% of gelatin and 1% of potassium bromide kept at 75° C. were simultaneously added at 6% aqueous solution of silver nitrate and a 8.4% aqueous solution of potassium bromide at a rate of 24 cc/min over a period of 9 minutes. Subsequently, 25 ml of a 10% aqueous solution of potassium bromide and 20 ml of a 5% solution of the silver halide solvent ($HO(CH_2)_2S(CH_2)_2S(CH_2)_2OH$) were added thereto. While stirring the mixture thoroughly and keeping the silver potential at −30 mV over a period of 78 minutes, 890 ml of a 11% aqueous solution of silver nitrate and a 9% aqueous solution of potassium bromide were added thereto. Subsequently, desalting was carried out by a flocculation method. The pH of the emulsion was adjusted to 6.3 and the pAg thereof was adjusted to 8.8 to obtain a monodisperse emulsion containing octahedral silver halide grains having a mean grain size of 0.93 μm and a coefficient of variation of 3.8%. To the emulsion were added 3.8 mg of sodium thiosulfate, 9.4 mg of chloroauric acid and 94 mg of potassium thiocyanate, each amount being per mol and silver (Emulsion A).

A hardening agent for gelating and a coating aid were added to the thus obtained emulsion. The emulsion and a coating composition for a gelating protective layer were simultaneously coated on a cellulose acetate film in such an amount as to give a coating weight of 20 mmol/$m^2$ in terms of silver (Film No. A101). A coated film was also obtained in the same manner as described above except that the following sensitizing dye D-1 in an amount corresponding to 50% at the saturated adsorption amount was added to Emulsion A, and the mixture was treated at 40° C. for 20 minutes to thereby allow the dye to be adsorbed (Film No. A102).

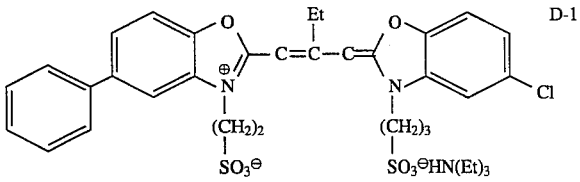

Separately, an emulsion was prepared in the same manner as in the preparation of Emulsion A, except that sensitizing dye D-1 was added before the chemical sensitization in an amount corresponding to 80% at the saturated adsorption amount (Emulsion B). The thus obtained emulsion was divided in portions. Fifty grains of active carbon (comparison), or 100 g, on a dry basis, of a porous organic synthetic resin (Diaion SK1B (comparison), Diaion SK10A (comparison), Diaion HP20SS, sepabeads SP207SS and SP800SS, tradenames of Mitsubishi Kasei Corporation; and synthetic adsorbents XAD-1, XAD-2 and XAD-4, tradenames of Rohm & Haas Co.) per Kg of the emulsion was immersed in methanol, thoroughly washed with water and added to the above portions. After stirring at 40° C. for 2 hours, these portions were immediately filtered through a microfilmer to remove the resins.

Using the thus treated emulsions, the same procedure as in the preparation of Film No. A101, was repeated to prepare coated films were prepared (Film Nos. B102-B110). Coated films were also obtained with the addition of sensitizing dye D-1 in the same manner as in the preparation of Film No. A102.

For control, a coated film was prepared in the same manner as in the preparation of Film No. A101 for using Emulsion B (Film No. B101), wherein the treatment with the porous organic synthetic resin was not conducted.

The resulting films were exposed to light from a tungsten lamp (color temperature: 2854° K.) through a continuous wedge and a color filter for one second. A combination of a UVD33S filter and a V40 filter as a blue exposure which excited silver halide was used as the color filter, and the samples were irradiated with light with a wavelength in the range of 330 to 400 nm. Further, the samples were irradiated by exposure through a Fuji gelatin filter SC-50 (manufactured by Fuji Photo Film Co., Ltd.) to screen light with a wavelength of 500 nm or below as a minus blue exposure which excited the dye. The exposed samples were developed with the following surface developing solution MAA-1 at 20° C. for 10 minutes.

| Surface Developing Solution MAA-1) | |
|---|---|
| Metol (N-methyl-p-aminophenol sulfate) | 2.5 g |
| L-Ascorbic Acid | 10 g |
| Nabox (sodium tetraboratge pentahydrate) (manufactured by Fuji Photo Film Co., Ltd.) | 35 g |
| Potassium Bromide | 1 g |
| Water to make | 1 liter |
| pH | 9.8 |

The optical density of each of the developed films was measured using a Fuji autographic densitometer (manufactured by Fuji Photo Film Co., Ltd.). The fog is referred to herein as the density of the unexposed area. The reciprocal of the exposure amount providing an optical density of (fog+0.2) is referred to herein as the sensitivity. The sensitivity is represented in terms of the relative sensitivity.

The results obtained by conducting the above-described exposure and development immediately after coating are shown in Table 15 below.

TABLE 15

| Film No. | Type of Adsorbent* | Addition of Dye-1 after Adsorbent Treatment | Blue Sensitivity | Minus Blue Sensitivity | Fog | Remark |
|---|---|---|---|---|---|---|
| | Change in Sensitivity caused by Treatment with Solid Adsorbent | | | | | |
| A101 | None | No | 80 | — | 0.05 | Comp. Ex. |
| A102 | None | Yes | 60 | 55 | 0.07 | Comp. Ex. |
| B101 | None | No | 100 (standard) | 100 (Standard) | 0.07 | Comp. Ex. |
| B102 | SK1B** | " | 90 | 0 | 0.05 | Comp. Ex. |
| B103 | SA10A*** | " | 102 | 0 | 0.05 | Comp. Ex. |
| B104 | activated carbon | " | 50 | 0 | 0.05 | Comp. Ex. |
| B105 | HP20SS | " | 140 | 0 | 0.05 | Invention |
| B106 | SP207SS | " | 141 | 0 | 0.06 | Invention |
| B107 | SP800SS | " | 138 | 0 | 0.05 | Invention |
| B108 | XAD-1 | " | 141 | 0 | 0.05 | Invention |
| B109 | XAD-2 | " | 140 | 0 | 0.07 | Invention |
| B110 | XAD-4 | " | 143 | 0 | 0.05 | Invention |
| B111 | SK1B** | Yes | 85 | 80 | 0.07 | Comp. Ex. |
| B112 | SA10A*** | " | 92 | 92 | 0.08 | Comp. Ex. |
| B113 | activated carbon | Yes | 41 | 38 | 0.06 | Comp. Ex. |
| B114 | HP20SS | " | 140 | 130 | 0.05 | Invention |
| B115 | SP207SS | " | 140 | 131 | 0.05 | Invention |
| B116 | SP800SS | " | 138 | 128 | 0.06 | Invention |
| B117 | XAD-1 | " | 140 | 135 | 0.05 | Invention |
| B118 | XAD-2 | " | 140 | 131 | 0.05 | Invention |
| B119 | XAD-4 | " | 141 | 130 | 0.05 | Invention |

*50 g of activated carbon and 100 g, on a dry basis, of synthetic adsorbents
**Diaion, cation exchange resin manufactured by Mitsubishi Kasei Corp.
***Diaion, anion exchange resin manufactured by Mitsubishi Kasei Corp.

As shown by the results in Table 15, it can be seen that when the emulsion which have been prepared using a silver halide solvent and been chemically sensitized in the presence of a dye, is treated with the porous organic synthetic resins used in the present invention, the sensitivity of the emulsion is greatly increased.

Immediately after coating, Film Nos. B101-B103, B105-B108, and B114-B117 shown in Table 15 were allowed to stand at 50° C. and 70% RH for 5 days, and then subjected to the same exposure and development as described above. The results obtained are shown in Table 16 below.

TABLE 16

| Film No. | Blue Sensitivity *Forced Condition Before | Blue Sensitivity *Forced Condition After | Minus Blue Sensitivity *Forced Condition Before | Minus Blue Sensitivity *Forced Condition After | Fog *Forced Condition Before | Fog *Forced Condition After | Remark |
|---|---|---|---|---|---|---|---|
| | Change in Sensitivity caused by Treatment with Solid Adsorbent | | | | | | |
| B101 | 100 | 80 | 100 | 75 | 0.05 | 0.25 | Comp. Ex. |
| B102 | 90 | 70 | — | — | 0.03 | 0.30 | Comp. Ex. |
| B103 | 102 | 80 | — | — | 0.04 | 0.28 | Comp. Ex. |
| B105 | 140 | 138 | — | — | 0.03 | 0.05 | Invention |
| B106 | 141 | 140 | — | — | 0.05 | 0.06 | Invention |
| B107 | 138 | 136 | — | — | 0.05 | 0.06 | Invention |
| B108 | 141 | 140 | — | — | 0.04 | 0.06 | Invention |
| B114 | 140 | 138 | 130 | 130 | 0.04 | 0.06 | Invention |
| B115 | 141 | 140 | 131 | 130 | 0.04 | 0.06 | Invention |
| B116 | 138 | 135 | 128 | 126 | 0.04 | 0.07 | Invention |
| B117 | 140 | 140 | 135 | 134 | 0.05 | 0.06 | Invention |

*Stored under forced condition of 50° C. and 70% RH for 5 days.

As shown by the results in Table 16, the occurrence of desensitization and fogging can be found after the untreated samples are stored under the forced conditions. On the other hand, the samples treated with the porous organic synthetic resins used in the present invention show that the occurrence of desensitization and fogging is hardly found. Accordingly, it can be found that when the treatment with the porous organic synthetic resins used in the present invention is carried out, the preservability of the films can be improved without the occurrence of desensitization and fogging.

EXAMPLE 10

To an emulsion containing octahedral silver halide grains prepared in the same manner as in Example 9 was added 0.1 g, per mol of silver halide, of the following compound M-1 and sensitizing dye D-1 as chemical sensitization aids. Further, 10.2 mg of sodium thiosulfate, 9.4 mg of chloroauric acid and 94 mg of potassium thiocyanate were added thereto. The emulsion was stirred at 60° C. for 60 minutes to carry out chemical sensitization. For the purpose of comparison, an emulsion chemical-sensitized under the same conditions as described above without using the chemical sensitization aid was prepared. Each of the thus-obtained emulsions was coated, and exposure and development were carried out in the same manner as in Example 9. The results obtained are shown in Table 17 below.

M-1

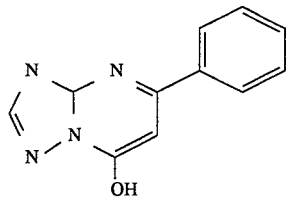

TABLE 17

| Film No. | Addition of M-1 | Kind of Adsorbent | Amount of D-1 added after Adsorbant Treatment* | Blue Sensitivity | Minus Blue Sensitivity | Remark |
|---|---|---|---|---|---|---|
| 120 | No | — | — | 100** | 100 | Comp. Ex. |
| 121 | Yes | — | — | 136 | 118 | " |
| 122 | " | SA10A*** | — | 98 | — | " |
| 123 | " | activated carbon | — | 70 | — | " |
| 124 | " | HP20SS | — | 181 | — | Invention |
| 125 | " | SP207SS | — | 180 | — | " |
| 126 | " | SP800SS | — | 178 | — | " |
| 127 | " | XAD-1 | — | 180 | — | " |
| 128 | " | XAD-2 | — | 173 | — | " |
| 129 | " | XAD-4 | — | 175 | — | " |
| 130 | " | SA10A*** | 50% | 90 | 85 | Comp. Ex. |
| 131 | " | activated carbon | 50% | 53 | 50 | " |
| 132 | " | HP20SS | 50% | 181 | 170 | Invention |
| 133 | " | " | 80% | 165 | 175 | " |
| 134 | " | SP207SS | 50% | 180 | 170 | " |
| 135 | " | " | 80% | 163 | 171 | " |
| 136 | " | SP800SS | 50% | 176 | 168 | " |
| 137 | " | " | 80% | 162 | 171 | " |
| 138 | " | XAD-1 | 50% | 178 | 170 | " |
| 139 | " | " | 80% | 160 | 172 | " |
| 140 | Yes | XAD-2 | 50% | 173 | 168 | Invention |
| 141 | " | " | 80% | 161 | 171 | " |
| 142 | " | XAD-4 | 50% | 175 | 170 | " |
| 143 | " | " | 80% | 160 | 171 | " |

*based on the saturated adsorption amount
**standard
***Diaion cation exchange resin made manufactured by Mitsubishi Kasei Corporation.

When chemical sensitization is carried out in the presence of the chemical sensitization aid as shown above, an emulsion having high sensitivity can be obtained. In Film No. 121, the minue blue sensitivity and the blue sensitivity are not increased. This is because the presence of M-1 inhibits the adsorption of D-1. Subsequently, the emulsion obtained by carrying out chemical sensitization in the presence of the chemical sensitization aid was treated with various adsorbents under the same conditions as in Example 9. Then, the sensitizing dye D-1 was added to the emulsion and allowed to be adsorbed by the emulsion at 40° C. for 20 minutes. Further, a hardening agent for gelating and a coating aid were added thereto, and the emulsion and a coating composition for a gelatin protective layer were simultaneously coated on a cellulose acetate film in such amount as to give a coating weight of 20 mmol/m$^2$ in terms of silver. As a result, the sensitivity of the emulsion was further increased with the treatment with the porous organic synthetic resin of the present invention. It was found that the resin treatment eliminated the adverse influence of M-1 so that almost all of D-1, which was added after the resin treatment in an amount corresponding to 80% at the saturated adsorption amount, could adsorb on the silver halide grains of the emulsion. Since the addition of D-1 can be conducted at a low temperature to prevent growth of J-aggregate, intrinsic desensitization can be lowered (as compound to Film No. 121). Further, the spectral sensitization can be effectively improved so that the color sensitivity can be markedly increased as compared to Film No. 121.

According to the present invention, the dyes are desorbed before the silver halide emulsions are coated on the support in the preparation of the silver halide emulsions. Accordingly, silver halide photographic materials with excellent chemical sensitization or spectral sensitization performance can be obtained.

While the invention has been described in detail and with reference to specific embodiments thereof, it is apparent to one skilled in the art that various changes and modifications can be made therein without departing from the spirit and the scope of the present invention.

What is claimed is:

1. A silver halide photographic material comprising a support having thereon at least one silver halide emulsion layer, wherein at least one silver halide emulsion layer contains a silver halide emulsion obtained by treating a silver halide emulsion containing a dye previously added thereto with a solid adsorbent which is a porous synthetic organic resin without an ion-exchange group to thereby desorb the dye adsorbed.

2. A silver halide photographic material as in claim 1, wherein said silver halide emulsion is one obtained by treating a silver halide emulsion with the solid adsorbent in the presence of a desorption accelerator for silver halide grains.

3. A silver halide photographic material as in claim 1, wherein said silver halide emulsion which is treated with said solid adsorbent comprises grains formed in the presence of the dye.

4. A silver halide photographic material as in claim 1, wherein said silver halide emulsion which is treated with said solid adsorbent is an emulsion chemically sensitized in the presence of the dye.

5. A silver halide photographic material as in claim 1, wherein said photographic material contains a silver halide emulsion obtained by desorbing a dye and then adding a spectral sensitizing dye.

6. A silver halide photographic material as in claim 1, wherein a nitrogen-containing heterocyclic compound having no spectrally sensitizing capability has been adsorbed onto the silver halide emulsion and then desorbed by a porous organic synthetic resin without an ion exchange group.

7. A silver halide photographic material as in claim 6, wherein the nitrogen-containing heterocyclic compound and the dye are added simultaneously to the silver halide emulsion .and are desorbed by the solid adsorbent at the same time.

8. A silver halide photographic material as in claim 7, wherein said silver halide emulsion which is treated with said solid adsorbent comprises grains formed in the presence of the dye and the nitrogen-containing heterocyclic compound having no spectrally sensitizing capability.

9. A silver halide photographic material as in claim 7, wherein said silver halide emulsion which is treated with said solid adsorbent is an emulsion chemically sensitized in the presence of the dye and the nitrogen-containing heterocyclic compound having no spectrally sensitizing capability.

10. A silver halide photographic material as in claim 6, wherein the nitrogen-containing heterocyclic compound is added to the silver halide emulsion during formation of the grains of the emulsion.

11. A silver halide photographic material as in claim 10, wherein the dye is added after grain formation.

12. A silver halide photographic material as in claim 11, wherein the formed grains are treated with the solid adsorbent to desorb the nitrogen-containing heterocyclic compound, the dye is then added, and after completion of chemical sensitization the silver halide emulsion is treated with the solid adsorbent to desorb the dye.

13. The silver halide photographic material as in claim 11, wherein the nitrogen containing heterocyclic compound and the dye are desorbed at the same time with the solid adsorbent.

14. A silver halide photographic material as in claim 6, wherein the nitrogen-containing heterocyclic compound is added after grain formation of the silver halide emulsion.

15. A silver halide photographic material as in claim 1, wherein a silver halide solvent has been adsorbed onto the silver halide emulsion and then desorbed by a porous organic synthetic resin without an ion exchange group.

16. A silver halide photographic material as in claim 15, wherein the silver halide solvent and the dye are added simultaneously to the silver halide emulsion and are desorbed by the solid adsorbent at the same time.

17. A silver halide photographic material as in claim 16, wherein said silver halide emulsion which is treated with said solid adsorbent comprises grains formed in the presence of the dye and the silver halide solvent having no spectrally sensitizing capability.

18. A silver halide photographic material as in claim 16, wherein said silver halide emulsion which is treated with said solid adsorbent is an emulsion chemically sensitized in the presence of the dye and the silver halide solvent.

19. A silver halide photographic material as in claim 15, wherein the silver halide solvent is added to the silver halide emulsion during formation of the grains of the emulsion.

20. A silver halide photographic material as in claim 19, wherein the dye is added after grain formation.

21. A silver halide photographic material as in claim 20, wherein the formed grains are treated with the solid adsorbent to desorb the silver halide solvent, the dye is then added, and after completion of chemical sensitization the silver halide emulsion is treated with the solid adsorbent to desorb the dye.

22. The silver halide photographic material as in claim 20, wherein the silver halide solvent and the dye are desorbed at the same time with the solid adsorbent.

23. A silver halide photographic material as in claim 15, wherein the silver halide solvent is added after grain formation of the silver halide emulsion.

* * * * *